US006514307B2

(12) United States Patent
Nakamura et al.

(10) Patent No.: US 6,514,307 B2
(45) Date of Patent: Feb. 4, 2003

(54) IRON-BASED SINTERED POWDER METAL BODY, MANUFACTURING METHOD THEREOF AND MANUFACTURING METHOD OF IRON-BASED SINTERED COMPONENT WITH HIGH STRENGTH AND HIGH DENSITY

(75) Inventors: Naomichi Nakamura, Chiba (JP); Satoshi Uenosono, Chiba (JP); Shigeru Unami, Chiba (JP); Masashi Fujinaga, Chiba (JP); Takashi Yoshimura, Kanagawa (JP); Mitsumasa Iijima, Kanagawa (JP); Shin Koizumi, Kanagawa (JP); Hiroyuki Anma, Kanagawa (JP); Yasuo Hatai, Kanagawa (JP)

(73) Assignees: Kawasaki Steel Corporation (JP); Unisia Jecs Corporation (JP)

( * ) Notice: Subject to any disclaimer, the term of this patent is extended or adjusted under 35 U.S.C. 154(b) by 0 days.

(21) Appl. No.: 09/934,428

(22) Filed: Aug. 21, 2001

(65) Prior Publication Data

US 2002/0048526 A1 Apr. 25, 2002

(30) Foreign Application Priority Data

Aug. 31, 2000 (JP) ..... 2000-263928
Jan. 24, 2001 (JP) ..... 2001-015655

(51) Int. Cl.[7] ..... C22C 33/02
(52) U.S. Cl. ..... 75/243; 75/244; 75/246
(58) Field of Search ..... 75/243, 244, 246

(56) References Cited

U.S. PATENT DOCUMENTS 4,464,205 A * 8/1984 Kumar et al.
4,497,669 A * 2/1985 Wang et al.
5,129,961 A * 7/1992 Hirai ..... 75/246
5,605,559 A * 2/1997 Unami et al. ..... 75/255
5,666,634 A * 9/1997 Unami et al. ..... 419/11
6,159,266 A * 12/2000 Yoshimura et al. ..... 75/243

FOREIGN PATENT DOCUMENTS

JP 2000-510907 8/2000

OTHER PUBLICATIONS

"Precision Cold Forging of a P/M Preform to Produce a High Density Spur Gear" by H. Ferguson & S. K. Smith, Society of Automotive Engineers, 1999–01–0294, p. 23–28.

* cited by examiner

*Primary Examiner*—Ngoclan Mai
(74) *Attorney, Agent, or Firm*—Schnader Harrison Segal & Lewis LLP

(57) ABSTRACT

An sintered iron-based powder metal body with outstandingly lower re-compacting load and having a high density and a method of manufacturing an iron-based sintered component with fewer pores of a sharp shape and having high strength and high density, the method comprising mixing, an iron-based metal powder containing at most about 0.05% of carbon, at most about 0.3% of oxygen, at most about 0.010% of nitrogen, with at least about 0.03% and at most about 0.5% of graphite powder and a lubricant, preliminarily compacting the mixture into a preform, the density of which is about 7.3 $Mg/m^3$ or more, and preliminarily sintering the preform in a non-oxidizing atmosphere in which a partial pressure of nitrogen is about 30 kPa or less at a temperature of about 1000° C. or higher and about 1300° C. or lower, thereby forming a sintered iron-based powder metal body with outstandingly lower re-compacting load and having high deformability, the density of which is about 7.3 $Mg/m^3$ or more and which contains at least about 0.10% and at most about 0.50 of carbon, at most about 0.010% of oxygen and at most about 0.010% of nitrogen, and which comprises at most about 0.02% of free carbon, and, further applying re-compaction and re-sintering and/or heat treatment thereby forming a sintered component, as well as the method alternatively comprising applying preliminary sintering in an atmosphere with no restriction of the nitrogen partial pressure and then annealing instead of the sintering step, thereby obtaining a sintered iron-based powder metal body with the nitrogen content of at most about 0.010%.

2 Claims, 2 Drawing Sheets

IRON-BASED SINTERED POWDER METAL BODY, MANUFACTURING METHOD THEREOF AND MANUFACTURING METHOD OF IRON-BASED SINTERED COMPONENT WITH HIGH STRENGTH AND HIGH DENSITY

BACKGROUND OF THE INVENTION

1. Field of the Invention

This invention relates to an iron-based sintered component formed of an iron-based metal powder as a raw material and suitable to machinery parts, or an iron-based powder metal body as an intermediate material suitable to manufacture of the sintered iron-based component.

2. Description of the Related Art

Powder metallurgical technology can produce a component having a complicated shape as a "near net shape" with high dimensional accuracy and can markedly reduce the cost of cutting and/or finishing. In such a near net shape, almost no mechanical processing is required to obtain or form a target shape. Powder metallurgical products are, therefore, used in a variety of applications in automobiles and other various fields. For reduction in size and weight of the components, demands have recently been made on such powder metallurgical products to have higher strength. Specifically, strong demands have been made on iron-based powder products (sintered iron-based components) to have higher strength.

A basic process for producing a sintered iron-based component (sometimes hereinafter referred to as "sintered iron-based compact" or simply as "sintered compact") includes the following sequential three steps (1) to (3):

(1) a step of mixing sub-material powders such as a graphite powder and/or copper powder and a lubricant such as zinc stearate or lithium stearate to an iron-based metal powder to yield an iron-based powder mixture;

(2) a step of charging the iron-based powder mixture into a die and pressing the mixed powder to yield a green compact; and (3) a step of sintering the green compact to yield a sintered compact.

The resulting sintered compact is subjected to a sizing or cutting process according to necessity to thereby yield a product such as a machine component. When a higher strength is required for the sintered compact, it is subjected to heat treatment for carburization or bright quenching and tempering.

The resulting green compact obtained through the steps (1) to (2) has a density of at greatest from about 6.6 to about 7.1 $Mg/m^3$ and, accordingly, a sintered compact obtained from the green compact has similar density.

In order to further increase the strength of such iron-based powder products (sintered iron-based components), it is effective to increase the density of the green compact to thereby increase the density of the resulting sintered compact obtained by subsequent sintering. The component has fewer voids and better mechanical properties such as tensile strength, impact resistance and fatigue strength when the sintered compact has a higher density.

A hot pressing technique, in which a metal powder is pressed while heating, is disclosed in, for example, Japanese Published Unexamined Patent Application No. 2-156002, Japanese Published Unexamined Patent Application No. 7-103404 and U.S. Pat. No. 5,368,630 as a pressing process for increasing the density of a green compact. For example, 0.5% by mass of a graphite powder and 0.6% by mass of a lubricant are added to a partially alloyed iron powder in which 4 mass % Ni, 0.5 mass % Mo and 1.5 mass % Cu are contained, to yield an iron-based powder mixture. The iron-based powder mixture is subjected to the hot pressing technique at a temperature of 150° C. under a pressure of 686 MPa to thereby yield a green compact having a density of about 7.30 $Mg/m^3$. However, application of the hot pressing technique requires heating facilities for heating the powder to a predetermined temperature which increases production cost and decreases dimensional accuracy of the component due to thermal deformation of the die.

Further, Japanese Published Unexamined Patent Applications No. 1-123005, for example, discloses sintering cold forging process as a combination of the powder metallurgical technology and cold forging that can produce a product having a substantially true density.

The sintering cold forging process is a molding/working method for obtaining a final product of high density composition by compacting a metal powder such as an iron-based powder mixture into a preform, preliminarily sintering the preform, cold forging and then re-sintering the same instead of the steps (2) and (3) described above. In this invention, the preliminarily sintered body is particularly referred to as a (iron-based) sintered powder metal body. Further, when it is referred to simply as a sintered body or sintered component, it means a sintered body obtained by re-sintering and/or heat treatment. The technique described in Japanese Published Unexamined Patent Application No. 1-123005 is a method of coating a liquid lubricant on the surface of a preform for cold forging and sintering, provisionally compacting the preform in a die, then applying a negative pressure to the preform to thereby suck and remove the liquid lubricant and then re-compact and re-sinter. According to this method, since the liquid lubricant coated and impregnated to the inside before the provisional compaction is sucked before the re-compaction, minute voids in the inside are collapsed and eliminated during re-compaction to obtain a final product with high density However, the density of the final sintered product obtained by this method is about 7.5 $Mg/M^3$ at the greatest and the strength has a limit.

For further improving the strength of the product (sintered body), it is effective to increase the concentration of carbon in the product. It is general in the powder metallurgy to mix a graphite powder as a carbon source with other metal powder materials, and it may be considered a method of obtaining a high strength sintered body by compacting and then preliminarily sintering a metal powder mixed with a graphite powder to form a sintered preform, further re-compacting and re-sintering (application of sintering/cold forging method). However, when preliminary sintering is applied in the existent method, about all of the mixed carbon diffuses into the matrix of the preform upon the preliminary sintering to increase the hardness of the sintered powder metal body. Therefore, when the sintered powder metal body is re-compacted, the re-compacting load increases remarkably and the deformability of the sintered powder metal body is lowered, so that it can not be fabricated into a desired shape. Accordingly, high strength and high density product can not be obtained.

For the problem described above, U.S. Pat. No. 4,393,563, for example, discloses a method of manufacturing a bearing component without pressing at high temperature. The method comprises the steps of mixing an iron powder, an iron alloying powder, a graphite powder and a lubricant, compacting the powder mixture into a preform, preliminarily sintering and then subjecting the same to cold forging with at least 50% plastic working, then re-sintering and annealing and roll forming the compact into a final product (sintered component). For the technique described in U.S. Pat. No. 4,393,563, it is described that when preliminary sintering is applied under the condition of suppressing diffusion of graphite, the preliminarily sintered component (preliminarily sintered body) has high deformability and can lower the compacting load in the subsequent cold forging. U.S. Pat. No. 4,393,563 recommends preliminary sintering conditions of 1100° C.×15–20 min. However, it has been found by the experiment of the present inventors that, under the conditions described above, graphite is completely diffused into the preform to remarkably increase the hardness of the material for sintered preform to make the subsequent cold forging difficult.

For the problem described above, Japanese Published Unexamined Patent Application No. 11-117002 proposes, for example, a sintered powder metal body by compacting a metal powder formed by mixing 0.3% having a structure where graphite remains at the grain boundary of the metal powder by weight or more of graphite with a metal powder mainly comprising iron to obtain a preform having a density of 7.3 g/cm$^3$ or more, and preliminarily sintering the preform within a temperature range, preferably, from 700 to 1000° C. According to this technique, since only the amount of carbon required for increasing the strength is solid solubilized by the preliminary sintering within the temperature range as described above to leave free graphite and prevent excess hardening of the iron powder, compacting material (sintered metal body) having low compacting pressure and high deformability can be obtained upon re-compaction step. However, although the metal powder compacting material (sintered powder metal body) obtained by this method has a high deformability in the re-compaction step, remaining free graphite is eliminated in the subsequent re-sintering to yield elongate voids (pore) to possibly lower the strength of the sintered product.

SUMMARY OF THE INVENTION

This invention intends to overcome the foregoing problems in the prior art and provide, at first, an iron-based sintered powder metal body capable of manufacturing a compact with outstandingly lower re-compacting load having outstandingly higher deformability compared with the prior art and having a high density upon manufacturing a powder metallurgical product starting from the iron-based powder mixture, as well as a manufacturing method thereof.

This invention also intends to provide a method of manufacturing an iron-based sintered body with fewer voids of a sharp shape and having high strength and high density.

In order to attain the subject described above the present inventors have made an earnest study on the compaction and preliminary sintering conditions. As a result, it has been found, for suppressing the occurrence of elongate voids, that it is effective to compact the iron-based powder mixture to a high density and, further, preliminarily sinter the same at a temperature enough to diffuse the added graphite into the matrix thereby reducing the amount of free graphite to substantially zero. Further, for remarkably decreasing the hardness of the sintered metal body even when the preliminary sintering is applied at such a temperature, it has been found to be effective that the nitrogen (N) content in the iron-based sintered powder metal body is reduced and, further, annealing is conducted succeeding to the preliminary sintering or the preliminary sintering is condacted in an atmosphere of suppressing nitridation. This can attain a low load upon re-compaction and can provide high density compact and, as a result, a sintered body of high density and high strength can be manufactured.

This invention has been accomplished by a further study based on the findings as described above.

That is, this invention relates, at first, to an iron-based sintered powder metal body the density of which is about 7.3 Mg/m$^3$ or more and which comprises, on the mass % basis, at least about 0.10% and at most about 0.50 of carbon and at most about 0.3% of oxygen and at most about 0.010% (preferably about 0.0050%) of nitrogen, and which comprises at most about 0.02% of free carbon, obtained by compaction and preliminarily sintering an iron-based powder mixture prepared by mixing an iron-based metal powder, a graphite powder and, optionally, a lubricant.

Another invention relates to a method of producing an iron-based sintered powder metal body comprising the steps of mixing at least, an iron-based metal powder comprising, on the mass % basis, at most about 0.05% of carbon, at most about 0.3% of oxygen, at most about 0.010% (preferably about 0.0050%) of nitrogen, with at least about 0.03% and at most about 0.5% of graphite powder based on the total weight of the iron-based metal powder and the graphite powder and, optionally, at least about 0.1 weight parts and at most about 0.6 weight parts of lubricant based on 100 weight parts of total weight of the iron-based metal powder and the graphite powder, resulting in an iron-based powder mixture, compacting the powder mixture into a preform, the density of which is about 7.3 Mg/m$^3$ or more, and preliminarily sintering the preform in a non-oxidizing atmosphere in which partial pressure of nitrogen is about 30 kPa or less and at a temperature of about 1000° C. or higher and about 1300° C. or lower.

As embodiment of another invention may adopt a method of manufacturing an sintered iron-based powder metal body comprising preliminarily sintering the preform at a temperature of about 1000° C. or higher and about 1300° C. or lower and then annealing the same. The atmosphere in the preliminary sintering has no particular restriction but it is preferably conducted in a non-oxidizing atmosphere at a nitrogen partial pressure of about 95 kPa or lower. Further, annealing is conducted preferably within a temperature from about 400 to about 800° C.

A further invention provides a method of manufacturing a high strength and high density iron-based sintered body comprising re-compacting the iron-based sintered powder metal body obtained by each of the methods of another invention and then re-sintering and/or heat treating the compact.

In each of the inventions described above, the composition for the iron-based sintered powder metal body or the composition for the iron-based powder mixture further contains, preferably, one or more of elements selected from the group consisting of, at most about 1.2% of manganese, at most about 2.3% of molybdenum, at most about 3.0% of chromium, at most about 5.0% of nickel, at most about 2.0% of copper, and at most about 1.4% of vanadium each on the mass % basis. The form of containing the alloying elements (Mn, Mo, Cr, Ni, Cu, V) in the iron-based metal powder has no particular restriction. It may be a mere mixture of an iron-based metal powder and an alloying powder but it is preferably a partially alloyed steel powder in which the alloying powder of the alloying elements described above is partially diffused and bonded to a surface of the iron-based metal powder. Further, pre-alloyed steel powder containing the alloying elements described above in the iron-based metal powder itself is also preferred. The forms of containment described above may be used in combination.

Further, in each of the inventions described above, for the composition of the iron-based sintered powder metal body or the composition for the iron-based powder mixture described above, other ingredients than those described above are not particularly restricted so long as most of the remainder (about 85% or more) is iron, and a composition comprising the remainder of Fe and inevitable impurities is preferred.

DETAILED DESCRIPTION OF THE INVENTION

Figure 1:
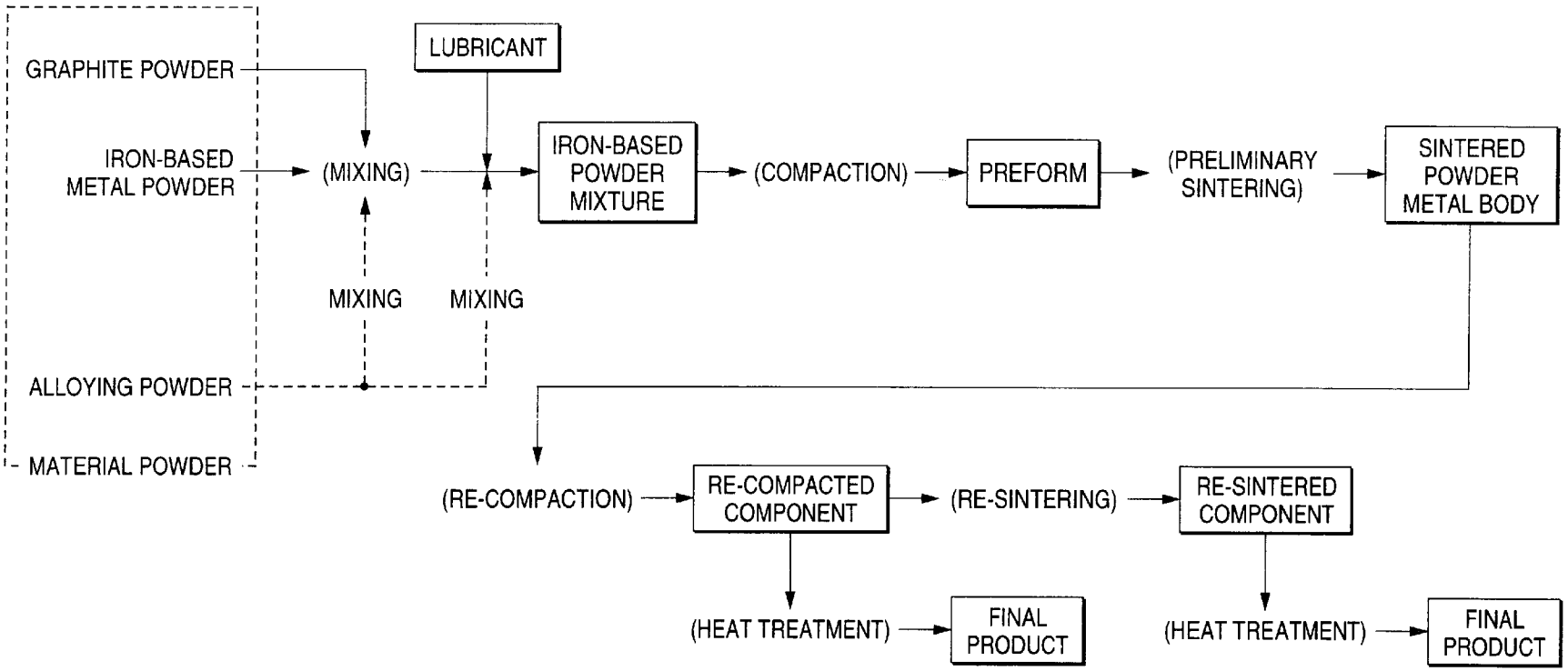
FIG. 1 is an explanatory view showing an example of a method of manufacturing a sintered powder metal body and a sintered component.

This invention provides at first an iron-based sintered powder metal body the density of which is about 7.3 $Mg/M^3$ or more and which comprises, on the mass % basis, at least about 0.10% and at most about 0.50% of carbon and at most about 0.3% of oxygen and at most about 0.010% (preferably about 0.0050%) of nitrogen, and which comprises at most about 0.02% of free carbon, obtained by compaction and preliminarily sintering an iron-based powder mixture prepared by mixing an iron-based metal powder, a graphite powder and, optionally, a lubricant.

Further, in this invention, the composition preferably contains one or more of elements selected from the group consisting of, at most about 1.2% of manganese, at most about 2.3% of molybdenum, at most about 3.0% of chromium, at most about 5.0% of nickel, at most about 2.0% of copper, and at most about 1.4% of vanadium, each on the mass % basis.

For the composition of the iron based sintered powder metal body, other elements than those described above are not particularly restricted so long as most of the remainder (about 85% or more) is iron, and a composition comprising the remainder of Fe and inevitable impurities is preferred.

This invention is to be described in details with reference to preferred embodiments.

The first invention provides an iron-based sintered powder metal body obtained by compaction and preliminarily sintering an iron-based powder mixture obtained by mixing at least an iron-based metal powder, a graphite powder and, optionally, a lubricant.

The iron-based sintered powder metal body according to this invention comprises a composition containing, on mass % basis, at least about 0.10% and at most about 0.50% of carbon, at most about 0.3% of oxygen, at most about 0.010% of nitrogen, or, further, containing one or more of elements selected from the group consisting of, at most about 1.2% of manganese, at most about 2.3% of molybdenum, at most about 3.0% of chromium, at most about 5.0% of nickel at most about 2.0% of copper, and at most about 1.4% of vanadium and, preferably, containing the remainder of iron and inevitable impurities. Each of the element of Mn, Mo, Cr, Ni, Cu and V may be added together with the graphite powder being mixed with the alloying powder upon obtaining the iron-based powder mixture but the partially alloying steel powder or pre-alloyed steel powder containing them is preferably used. The forms of addition may be used in combination.

At first, the reason for defining the composition of the iron-based sintered powder metal body according to this invention is to be explained.

C: About 0.10 to About 0.50 Mass %

C is controlled within a range from about 0.10 to about 0.50 mass % considering the hardenability upon carburization quenching or bright quenching, as well as in accordance with a required strength of a sintered component. For ensuring a desired hardenability, the C-content is desirably about 0.10 mass % or more. On the other hand, it is preferably about 0.50 mass % or less in order to avoid excessive high hardness of the sintered metal body and excessive high compacting load upon re-compaction.

O: About 0.3 Mass % or Less

O is an element contained inevitably in the iron-based metal powder. Since the hardness of the sintered powder metal body increases and the compacting load upon re-compaction increases as the O-content increases, it is preferably reduced as much as possible. For avoiding remarkable increase in the load during re-compaction, the upper limit for the O-content is preferably about 0.3 mass %. Since the lower limit for the O-content in the iron-based metal powder that can be produced industrially stably is about 0.02 mass %, the lower limit for the O-content in the iron-based sintered powder metal body is preferably about 0.02 mass %.

N: About 0.010 Mass % or Less

N is an element like C for increasing the hardness of the sintered powder metal body and the N content is desirably reduced as low as possible in order to keep the hardness of the sintered powder metal body lower and reduce the re-compaction load in the invention in which the graphite is solid solubilized in the iron-based metal powder and free graphite is made substantially zero. When N is contained in excess of about 0.010 mass %, the compacting load upon re-compaction is remarkably increased, so that N is restricted to about 0.010 mass % or less in this invention. It is preferably about 0.0050 mass % or less. In view of the quality of the sintered powder metal body, there is no particular restriction for defining the lower limit of the N content but it is industrially difficult to lower the content to about 0.0005 mass % or less.

One or more of elements selected from Mn: about 1.2 mass % or less, Mo: about 2.3 mass % or less, Cr: about 3.0 mass % or less, Ni: about 5.0 mass % or less, Cu: about 2.0 mass % or less, V: about 1.4 mass % or less Each of Mn, Mo, Cr, Ni, Cu and V is an element for improving the quenching property and one or more of them can be selected and contained as necessary with an aim of ensuring the strength of the sintering component. In order not to remarkably increase the hardness of the sintered powder metal body and not to increase the re-compaction load, it is preferred to define the content as:

at most about 1.2 mass % of manganese, at most about 2.3 mass % of molybdenum, at most about 3.0 mass % of chromium, at most about 5.0 mass % of nickel at most about 2.0 mass % of copper, and at most about 1.4 mass % of vanadium, respectively.

More preferred contents for Mn, Mo and V are at most about 1.0 mass % of manganese, at most about 2.0 mass % of molybdenum and at most about 1.0 mass % of vanadium. In view of the quality of the sintered powder metal body, there is no particular requirement for defining the lower limit of each of the contents of Mn, Mo, Cr, Ni, Cu and V but for distinguishing them from the containment as impurities, the lower limit may be defined, as the additive, at about Mn: 0.04 mass %, Mo: 0.005 mass %, Cr: 0.01 mass %, Ni: 0.01 mass %, Cu: 0.01 mass %, V: 0.005 mass %.

Balance of Fe and Inevitable Impurities

The remainder of the elements other than those described above preferably comprises Fe and inevitable impurities. The inevitable impurities include Mn, Mo, Cr, Ni, Cu and V each by less than the lower limit described above. As other impurities, at most about 0.1 mass % or less of phosphorus, at most about 0.1 mass % of sulfur and at most about 0.2 mass % of silicon are permissible for instance. In view of the industrial productivity, the lower limit for the impurity elements may be defined to about 0.001 mass % of phosphorus, about 0.001 mass % of sulfur and about 0.01 mass % of Si. In a case where other impurity elements or additive elements than those described above are contained, it is preferred that the sintered powder metal body composition comprises at least about 85% of iron in order to keep the compacting load upon re-compaction lower and ensure the strength of the re-sintered body.

Free Graphite: About 0.02% or Less

The sintered iron-based powder metal body of this invention is obtained by compacting and preliminarily sintering iron-based powder mixture obtained by mixing at least an iron-based metal powder, a graphite powder and, optionally, a lubricant and has a structure where graphite is diffused into a matrix of the iron-based metal and no free graphite (graphite not diffused into the matrix) is substantially present. In the sintered iron-based powder metal body according to this invention, the free graphite is reduced substantially zero, that is, about 0.02 mass % or less by controlling the preliminary sintering condition. That is, a graphite powder is almost diffused into the iron-based metal powder by compaction and preliminary sintering, is present as a solid solution in the matrix, or present being deposited as carbides but scarcely remains as free graphite. When the amount of free graphite exceeds about 0.02 mass %, a phenomenon that graphite particles extend along the metal flow upon re-compaction to form a graphite extension layer becomes remarkable. Therefore, when graphite is diffused into the iron-base metal matrix and dissipated upon re-sintering, traces of the graphite extension layer remain as elongate voids. The elongate voids act as defects in the sintering body to sometimes lower the strength. Therefore, the free graphite is limited to about 0.02 mass % or less.

Figure 2:
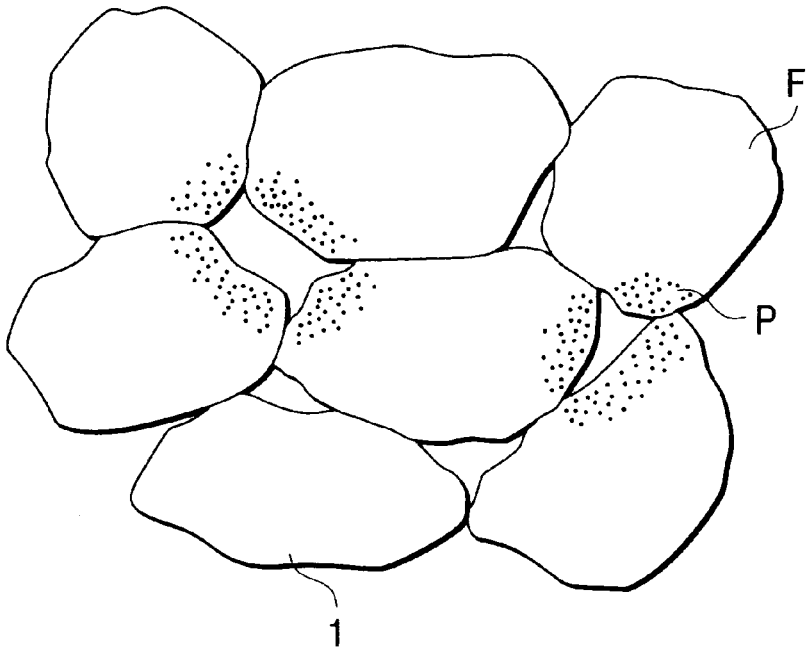
FIG. 2 is a schematic view schematically showing the structure of a sintered powder metal body.

FIG. 2 schematically shows an example of a structure of an iron-based sintered powder metal body according to this invention. The structure of the sintered powder metal body comprises a ferrite phase (F) as a main phase in which a pearlite phase (P) is present together in a region where graphite is diffused. The hardness of the sintered powder metal body can be controlled to such an extent as not hindering re-compaction by controlling the preliminary sintering condition within the range of the invention.

The sintered iron-based powder metal body according to this invention has a density of about 7.3 $Mg/m^3$ or more. By compacting the iron-based powder mixture into a preform under the condition that the density of the preform is about 7.3 $Mg/m^3$ or more, area of contact between each of the iron-based metal powder particles increases and material diffusion by way of the face of contact prevails over a wide range. Accordingly, a sintered powder metal body of large elongation and high deformability is obtained. The density is more preferably about 7.35 $Mg/m^3$ or more. Higher density of the sintered metal body is more preferred but a practical upper limit is defined as about 7.8 $Mg/m^3$ in view of the restriction by the cost such as die life. More practically, a suitable range is from about 7.35 to about 7.55 $Mg/m^3$.

Then, the method of another invention for manufacturing the sintered iron-based powder metal body is to be explained below.

A first embodiment of another invention provides a method of producing an iron-based sintered powder metal body comprising the steps of mixing at least, an iron-based metal powder comprising, on the mass % basis, at most about 0.05% of carbon, at most about 0.3% of oxygen, at most about 0.010% of nitrogen, and remainder being preferably iron and inevitable impurities, with at least about 0.03% and at most about 0.5% of graphite powder based on the total weight of the iron-based metal powder and the graphite powder and, optionally, at least about 0.1 weight parts and at most about 0.6 weight parts of lubricant based on 100 weight parts of total weight of the iron-based metal powder and the graphite powder, resulting in an iron-based powder mixture, compacting the powder mixture into a preform, the density of which is about 7.3 $Mg/m^3$ or more, and preliminarily sintering the preform in a non-oxidizing atmosphere in which partial pressure of nitrogen is about 30 kPa or less and at a temperature of about 1000° C. or higher and about 1300° C. or lower.

In the first embodiment of another invention, the iron-based mixed powder preferably contains, in addition to the composition described above, on the mass % basis, one or more elements selected from the group consisting of, at most about 1.2% of manganese, at most about 2.3% of molybdenum, at most about 3.0% of chromium, at most about 5.0% of nickel at most about 2.0% of copper, and at most about 1.4 mass % of vanadium In this case, the remainder of the elements other than those described above preferably comprise Fe and inevitable impurities.

In the first embodiment of another invention, the iron-based metal powder comprises, in addition to the composition described above, on the mass % basis, one or more of alloying elements selected from the group consisting of at most about 1.2% of manganese, at most about 2.3% of molybdenum, at most about 3.0% of chromium, at most about 5.0% of nickel at most about 2.0% of copper, and at most about 1.4% of vanadium (preferably, the remainder being Fe and inevitable impurity).

Further, at least a portion of the alloying elements is partially diffusion bonded as an alloying particles to a surface of the iron-based metal powder to form a partially alloyed steel powder.

Further, in the first embodiment of another invention, the iron-based metal powder preferably comprises also a pre-alloyed steel powder containing in addition to the composition described above, one or more of elements selected from the group consisting of, at most about 1.2 mass % of manganese,
at most about 2.3 mass % of molybdenum,
at most about 3.0 mass % of chromium,
at most about 5.0 mass % of nickel
at most about 2.0 mass % of copper, and
at most about 1.4 mass % of vanadium (preferably, the remainder being Fe and inevitable impurities).

That is, there is no particular restriction on the method of containment for one or more of alloying element selected from the group consisting of Mn, Mo, Cr, Ni, Cu and V. The method may be mere mixing but they are preferably contained in the form of a partially alloyed steel powder or pre-alloyed steel powder into the iron-based metal powder. The forms of addition may be used in combination.

Further, a second embodiment of another invention provides a method of manufacturing an iron-based sintered powder metal body comprising the step of mixing at least, an iron-based metal powder comprising a composition containing, on the mass % basis,
at most about 0.05% of carbon,
at most about 0.3% of oxygen,
at most about 0.010% of nitrogen, and
remainder being preferably iron and inevitable impurities, with a graphite powder of at least about 0.03 mass % and at most about 0.5 mass % based on the total weight of the iron-based powder and the graphite powder and, optionally, a lubricant of at least about 0.1 weight parts and at most about 0.6 weight parts based on 100 weight parts of total weight of the iron-based metal powder and the graphite powder, resulting in an iron-based powder mixture
compacting the powder mixture into a preform having a density of about 7.3 $Mg/M^3$ or more, and preliminarily sintering and then annealing the preform.

The preliminary sintering is preferably conducted in a non-oxidizing atmosphere at about 95 kPa or less. Further, annealing is preferably conducted at a temperature from about 400 to about 800° C.

In the second embodiment of another invention, the iron-based powder mixture may be a composition comprising, in addition to the composition described above, on the mass % basis, one or more of elements selected from the group consisting of,
at most about 1.2% of manganese,
at most about 2.3% of molybdenum,
at most about 3.0% of chromium,
at most about 5.0% of nickel
at most about 2.0% of copper, and
at most about 1.4% of vanadium and the remainder preferably being Fe and inevitable impurities.

Further, in the second embodiment of another invention, the iron or iron-based metal powder preferably contains, in addition to the composition described above, on the mass % basis, one or more of elements selected from the group consisting of,
at most about 1.2% of manganese,
at most about 2.3% of molybdenum,
at most about 3.0% of chromium,
at most about 5.0% of nickel
at most about 2.0% of copper, and
at most about 1.4% of vanadium (preferably, the remainder being Fe and inevitable impurities).

Further, at least a portion of the alloying elements may be partially diffusion bonded as alloying particles to the surface of the iron-based metal powder particles to form a partially alloyed steel powder.

Further, in the second embodiment of another invention, the iron-based metal powder may be a pre-alloyed steel powder containing, in addition to the composition above, on the mass % basis, one or more of elements selected from the group consisting of,
at most about 1.2% of manganese,
at most about 2.3% of molybdenum,
at most about 3.0% of chromium,
at most about 5.0% of nickel
at most about 2.0% of copper, and
at most about 1.4% of vanadium (preferably, the remainder being Fe and inevitable impurities).

That is, there is no restriction for the method of containment of one or more of alloying elements selected from the group consisting of Mn, Mo, Cr, Ni, Cu and V to the iron-based powder mixture. It method may be mere mixing but they are preferably contained in the iron-based metal powder in the form of a partially alloyed steel powder or a pre-alloyed steel powder. The addition forms may be used in combination.

Preferred embodiments of another invention are to be explained specifically.

FIG. 1 shows an example of the step of manufacturing a sintered iron-based powder metal body. As the raw material powder, an iron-based metal powder, a graphite powder and, further, an alloying powder are used.

As the iron-based metal powder used, those having a composition containing, on the mass % basis, at most about 0.05% of carbon, at most about 0.3% of oxygen and at most about 0.010% of nitrogen and the remainder of Fe and inevitable impurities are suitable.

That is, it is preferred that C is at most about 0.05%, 0 is at most about 0.3% and N is at most about 0.010% in order to prevent lowering of compressibility by hardening of the powder and attain the density of the sintered powder metal body of about 7.3 $Mg/m^3$ or more. A preferred N amount in the iron-based metal powder is at most about 0.0050 mass %.

The O content is preferably as low as possible in view of the compressibility. O is an element contained inevitably and the lower limit is desirably at about 0.02% which is a level not increasing the cost economically and practicable industrially. A preferred O content is from about 0.03 to about 0.2 mass % with an industrially economical point of view. In the same manner, each of the lower limit values for the preferred C content and N content in view of the industrial economical point is about 0.0005 mass %. N and O intruded into the sintered powder metal body from the raw-material powders other than the iron-based metal powder generally used industrially are negligible.

Further, there is no particular restriction for the grain size of the iron-based metal powder used in this invention and a grain size of about 30 to about 120 μm in average is desirable since they can be manufactured industrially at a reduced cost. The average grain size is defined as the value at the mid-point of the weight accumulation grain size distribution (d50).

Further, in another invention, one or more of elements selected from the group consisting, on the mass % basis, of at most about 1.2% of manganese, at most about 2.3% of molybdenum, at most about 3.0% of chromium, at most about 5.0% of nickel at most about 2.0% of copper, and at most about 1.4% of vanadium may be contained in addition to the composition described above.

Referring to the preferred contents for Mn, Mo and V, Mn is at most about 1.0 mass %, Mo is at most about 2.0 mass % and V is at most about 1.0 mass %. Each of Mn, Mo, Cr, Ni, Cu and V can be selected and incorporated as necessary in order to increase the strength of the sintered body or enhance the hardenability. The alloying elements may be prealloyed to the iron-based metal powder, or particles of alloying powder may be partially diffused and bonded to the iron-based metal powder particles, or may be mixed as a metal powder (alloying powder).

Further, the containment methods described above may be used in combination. For example, it may be considered as a suitable embodiment to select and combine optimal incorporation methods on every element to be added. In each of the cases, in order to avoid undesired effects that the hardness of the sintered powder metal body increases to increase the compacting load upon re-compaction, it is preferred that the upper limits are defined as about 1.2 mass % for manganese, about 2.3 mass % for molybdenum, about 3.0 mass % for chromium, about 5.0 mass % for Ni, about 2.0 mass % for Cu and about 1.4 mass % for V, respectively.

In view of the quality of the sintered powder metal body, there is no particular requirement for defining the lower limit of each of the contents of Mn, Mo, Cr, Ni, Cu and V but for distinguishing them from the containment as impurities, the lower limit may be defined, as the additives, at about Mn: 0.01 mass %, Mo: 0.01 mass %, Cr: 0.01 mass %, Ni: 0.01 mass %, Cu: 0.01 mass %, V: 0.01 mass %.

The remainder of the components other than the described above preferably comprises Fe and inevitable impurities. The inevitable impurities include Mn, Mo, Cr, Ni, Cu and V each by less than the lower limit described above. As other impurities, at most about 0.1 mass % of phosphorus, at most about 0.1 mass % of sulfur and at most about 0.2 mass % of silicon are permissible for instance. In view of the industrial productivity, the lower limits for the impurity elements may be defined to about 0.001 mass % of phosphorus, about 0.001 mass % of sulfur and about 0.005 mass % of Si.

In a case where other impurity elements or additive elements than those described above are contained, it is preferred that the sintered powder metal body composition comprises at least about 85% of iron in order to keep the re-compaction load lower and ensure the strength of the re-sintered body.

The graphite powder used as one of the raw material powder is contained by from about 0.03 to about 0.5 mass % to the iron-based powder mixture based on the total amount of the iron-based metal powder and the graphite powder for ensuring a predetermined strength of the sintered body or increasing the hardenability upon heat treatment. The content for the graphite powder is preferably about 0.03 mass % or more in order not to cause insufficiency for the effect of improving the strength of the sintering component. On the other hand, for avoiding excess compacting load upon re-compaction, the content is preferably about 0.5 mass % or less. Therefore, the content of the graphite powder in the iron-based powder mixture is from about 0.03 to about 0.5 mass % based on the total amount of the iron-based metal powder and the graphite powder.

Further, with an aim, for example, of preventing segregation of the graphite powder in the iron-based powder mixture, wax, spindle oil or the like may be added into the iron-based powder mixture in order to improve the bonding of the graphite powder to the surface of the iron-based metal powder particles. Further, the bonding of the graphite powder particles to the surface of the iron-based metal powder can be improved by applying the segregation preventive treatment as described, for example, in Japanese Published Unexamined Patent Applications No. 1-165701 and No. 5-148505.

Further, in addition to the raw material powders, a lubricant may further be incorporated with an aim of improving the compaction density in the compaction and reducing the stripping force from a die. The lubricant usable can include, for example, zinc stearate, lithium stearate, ethylene bisstearoamide, polyethylene, polypropylene, thermoplastic resin powder, polyamide, stearic amide, oleic acid and calcium stearate. The content of the lubricant is preferably from about 0.1 to about 0.6 parts by weight based on 100 parts by weight for the total amount of the iron-based metal powder and the graphite powder. This invention is suitable to cold compaction/re-compaction step and the lubricant may also be selected preferably so as to be suitable to cold working.

For mixing the iron-based powder mixture, a usually known mixing method, for example, a mixing method of using a Henschel mixer or a corn type mixer is applicable.

The iron-based powder mixture mixed at the composition and the ratio described above is then compacted to form a preform having a density of about 7.3 $Mg/m^3$ or more. As the density of the preform is about 7.3 $Mg/m^3$ or more, the area of contact between each of the iron-based metal powder particles increases to promote the volumic diffusion or face diffusion of metal atoms by way of the contact surface or cause melting between the particle surface to each other over a wide range upon preliminary sintering as the next step, so that large extendability is obtained upon re-compaction to attain high deformability.

In the compaction, known compaction techniques, particularly, die press molding technique can be applied. For example, each of the compaction methods such as a die lubrication method, a multi-stage molding method using a split die, a CNC pressing method, a hydrostatic pressing method, a hot pressing method, a compaction method described in Japanese Published Unexamined Patent Application No. 11-117002 or a method in combination of them is preferred. Further, roll forming method or the like may be used alone or in combination. Among the compaction methods described above, cold compaction methods (those other than the hot forming method described above) are suitable in view of the dimensional accuracy and the production cost. In the compaction method described in Japanese Published Unexamined Patent Application No. 11-117002, the molding device comprises a molding die having a molding space and, an upper punch and a lower punch inserted into the molding die for pressing the powder mixture. Then, the molding space comprises a larger diameter portion in which the upper punch is inserted, a smaller diameter in which the lower punch is inserted and a tapered portion connecting them. Then, a recess for increasing the volume of then molding space is disposed to the outer circumferential edge of an end face facing the molding space of the molding die to which one or both of the upper punch the lower punch are opposed. By the use of the device of the constitution described above, spring back or stripping force for the compact after pressing are restricted and a compact at high density can be manufactured easily.

Then, the preform is preliminarily sintered into a sintered powder metal body.

In the first embodiment, the preliminary sintering is preferably conducted in a non-oxidizing atmosphere at a nitrogen partial pressure of about 30 kPa or less and at a temperature from about 1000° C. to about 1300° C. When the preliminary sintering temperature is lower than about 1000° C., the residual amount of free graphite sometimes increases, which forms elongate pore during re-sintering in the subsequent step and they act as defects to the final product used under severe stress to possibly lower the strength. On the other hand, if the preliminary sintering temperature exceeds about 1300° C., since the effect of improving the deformability is saturated, it is preferred to define the upper limit to about 1300° C. for avoiding remarkable increase in the manufacturing cost. For this purpose, the preliminary sintering temperature is preferably defined as from about 1000° C. to about 1300° C.

In this invention, the preliminary sintering is conducted preferably in a non-oxidizing atmosphere at a nitrogen partial pressure of about 30 kPa or less such as in vacuum, in an Ar gas or hydrogen gas. Lower nitrogen partial pressure is more advantageous for decreasing the N content in the sintered powder metal body. A preferred atmosphere is, for example, a hydrogen-nitrogen gas mixture at a hydrogen concentration of about 70 vol% or more. On the other hand, when the nitrogen pressure exceeds about 30 kPa, it is difficult to reduce the N content in the sintered powder metal body to about 0.010 mass % or less. There is no particular requirement for defining the lower limit of the nitrogen partial pressure but an industrially attainable level is about $10^{-5}$ kPa. This is identical also in the annealing treatment to be described later.

The processing time for the preliminary sintering is properly set depending on the purpose or the condition and it is conducted usually within a range from about 600 to about 7200 s.

On the other hand, as a second embodiment instead of the first embodiment, the present inventors have found that the deformability of the sintered powder metal body (cold forgeability) can be improved remarkably by conducting annealing at a lower temperature than the preliminary sintering temperature after applying the preliminary sintering in an atmosphere with no restiction to the preform. This reason is not always apparent at present but it is observed that the N content in the sintered powder metal body is reduced by applying the annealing and it is considered that denitridation effect by the annealing is one of the reasons for improving the defoamability of the sintered powder metal body. That is, it is estimated that transformation to the α-phase proceeds in the preliminarily sintered body in the annealing step to lower the solubility of nitrogen to the iron-based matrix, so that the nitrogen concentration is lowered. Further, denitridation other than the annealing may also be adopted but the annealing is most preferred in view of the economicity or absence of undesired effect on the defoamability of the sintered powder metal body.

In a case where N in the sintered powder metal body is decreased to improve the compressibility, the atmosphere for the preliminary sintering prior to the annealing has no particular restriction. However, the nitrogen partial pressure in the preliminary sintering atmosphere is preferably about 95 kPa or less in order to keep the nitrogen content in the sintered metal body to about 0.010 mass % or less. Further, for preventing hardening by oxidation, the non-oxidizing atmosphere is preferably used.

For keeping the nitrogen content in the sintered powder metal body to about 0.010 mass % or less, the annealing after the preliminary sintering is preferably conducted at a temperature within a range from about 400° C. to about 800° C. This is because the effect of reducing the nitrogen amount is greatest within the annealing temperature range from about 400° C. to about 800° C. Further, the atmosphere for the annealing is preferably non-oxidizing by the same reason as that for the atmosphere upon preliminary sintering. Further, the denitriding efficiency is improved more by restricting the nitrogen partial pressure in the atmosphere for the annealing to about 95 kPa or less. The nitrogen partial pressure in the atmosphere upon annealing and the nitrogen partial pressure in the atmosphere upon preliminary sintering may not necessarily be identical.

Further, the annealing time is preferably within a range from about 600 to about 7200 s. Annealing for the annealing time of about 600 s or more can provide a sufficient effect of reducing nitrogen. On the other hand, since the effect is saturated, if the annealing time exceeds about 7200 s, the upper limit is preferably about 7200 s in view of the productivity. A further preferred lower limit is about 1200 s and further preferred upper limit is about 3600 s.

Further, the preliminary sintering and the succeeding annealing may be conducted continuously with no problem without taking out the material from a sintering furnace conducting the preliminary sintering. That is, the material may be preliminarily sintered, cooled to in the range between about 400° C. and about 800° C. and then annealed as it is. Further, the material may be preliminarily sintered, cooled to lower than about 400° C. and then annealed at about 400 to about 800° C. Further, there is no requirement for uniformly keeping the temperature constant and it may be cooled gradually between about 400 to about 800° C. In the gradual cooling, the cooling rate may be lowered such that it takes an additional time by from about 600 to about 7200 s, preferably, about 3600 to about 7200 s relative to a time to pass the temperature range at a usual cooling rate (about 2400 s).

The sintered powder metal body is re-compacted into a re-compacted component.

The sintered powder metal body according to this invention obtained by the steps described above can be re-compacted by the known method and then re-sintered and/or heat treated to form a high strength and high density iron-based sintered body. Since the sintered powder metal body according to this invention has a high deformability, application of cold forging which is advantageous in view of the cost and the dimensional accuracy is more preferred for the re-compaction step.

Then, a further invention as the method of manufacturing a high strength and high density iron-based sintered body is to be explained.

That is, a first embodiment of this further invention provides a method of producing an iron-based sintered body comprising the steps of mixing at least, an iron-based metal powder having a composition comprising, at most about 0.05 mass % of carbon, at most about 0.3 mass % of oxygen, at most about 0.010 mass % of nitrogen, and remainder being preferably iron and inevitable impurities, with a graphite powder of at least about 0.03 mass % and at most about 0.5 mass % based on the total weight of the iron-based powder and the graphite powder or, optionally, a lubricant of at least about 0.1 weight parts and at most about 0.6 weight parts based on 100 weight parts of total weight of the iron-based metal powder and the graphite powder, resulting in an iron-based powder mixture, compacting the iron-based powder mixture into a preform, the density of which is about 7.3 $Mg/m^3$ or more, preliminarily sintering the preform in a non-oxidizing atmosphere at a partial pressure of nitrogen of about 30 kPa or less and at a temperature of about 1000° C. or higher and about 1300° C. or lower, resulting in a sintered powder metal body, re-compacting the sintered powder metal body into a re-compacted component, and re-sintering and/or heat treating the re-compacted component.

Further, in the first embodiment of this further invention, the iron-based powder mixture preferably has a composition comprising, in addition to the composition described above, on the mass % basis, one or more of elements selected from the group consisting of, at most about 1.2% of manganese, at most about 2.3% of molybdenum, at most about 3.0% of chromium, at most about 5.0% of nickel, at most about 2.0% of copper, and at most about 1.4% of vanadium, further preferably, comprising the remainder of Fe and inevitable impurities.

Further, the iron-based metal powder preferably comprises, in addition to the composition, on the mass % basis, one or more of elements selected from the group consisting of, at most about 1.2% of manganese, at most about 2.3% of molybdenum, at most about 3.0% of chromium, at most about 5.0% of nickel, at most about 2.0% of copper, and at most about 1.4% of vanadium, (preferably, a composition comprising the remainder of Fe and inevitable impurities).

Further, it may be preferably a partially alloyed steel powder formed by partially diffusion bonding at least a portion of the alloying elements as alloying particles to the surface of the iron-based metal powder particles.

In the first embodiment of this further invention, the iron-based metal powder is also preferably a pre-alloyed powder which further comprises, in addition to the composition described above, on the mass % basis, one or more of elements selected from the group consisting of, at most about 1.2% of manganese, at most about 2.3% of molybdenum, at most about 3.0% of chromium, at most about 5.0% of nickel, at most about 2.0% of copper, and at most about 1.4% of vanadium, (preferably, composition comprising the remainder of Fe and inevitable impurities.

That is, there is no particular restriction on the method of containment for one or more of alloying elements selected from Mn, Mo, Cr, Ni, Cu and V to the iron-based powder mixture. It may be a mere mixture but it is preferably contained in the form of a partially alloyed steel powder or pre-alloyed steel powder to the iron-based metal powder. The addition forms may be used in combination.

Further, in the second embodiment of this further invention provides a method of manufacturing a high strength and high density iron-based sintered body comprising the steps of: mixing at least, an iron-based metal powder having a composition consisting of, at most about 0.05 mass % of carbon, at most about 0.3 mass % of oxygen, at most about 0.010 mass % of nitrogen, and remainder being preferably iron and inevitable impurities, with a graphite powder of at least about 0.03 mass % and at most about 0.5 mass % based on the total weight of the iron-based metal powder and the graphite powder and, optionally, a lubricant of at least about 0.1 weight parts and at most about 0.6 weight parts based on 100 weight parts of total weight of the iron-based powder and the graphite powder, resulting in an iron-based powder mixture, compacting the iron-based powder mixture into a preform, the density of which is about 7.3 $Mg/M^3$ or more, preliminary sintering the preform at a temperature of about 1000° C. or higher and about 1300° C. or lower, annealing the preliminarily sintered body, resulting in a sintered powder metal body, re-compacting the sintered powder metal body, to form a re-compacted component, and re-sintering and/or heat treating the component.

The preliminary sintering is preferably conducted in a non-oxidizing atmosphere at about 95 kPa or less. Further, annealing is conducted preferably at a temperature from about 400 to about 800° C.

In the second embodiment of this further invention, the iron-based powder mixture has a composition further comprising, in addition to the composition described above, on the mass % basis, one or more of elements selected from the group consisting of, at most about 1.2% of manganese, at most about 2.3% of molybdenum, at most about 3.0% of chromium, at most about 5.0% of nickel, at most about 2.0% of copper, and at most about 1.4% of vanadium, and, the remainder being, preferably, Fe and inevitable impurities.

Further, the iron-based metal powder may further comprise, in addition to the composition described above, on the mass % basis, one or more of alloying elements selected from the group consisting of, at most about 1.2% of manganese, at most about 2.3% of molybdenum, at most about 3.0% of chromium, at most about 5.0% of nickel, at most about 2.0% of copper, and at most about 1.4% of vanadium, (preferably, composition comprising the remainder of Fe and inevitable impurity).

Further, it may be a partially alloyed steel powder formed by partially diffusion bonding at least a portion of the alloying elements described above to the surface of the iron-based metal powder particles as alloying particles.

Further, in the second embodiment of this further invention, the iron-based metal powder may be a pre-alloyed steel powder further comprising, in addition to the composition described above, on the mass % basis, one or more of elements selected from the group consisting of, at most about 1.2% of manganese, at most about 2.3% of molybdenum, at most about 3.0% of chromium, at most about 5.0% of nickel, at most about 2.0% of copper, and at most about 1.4% of vanadium, (preferably, composition comprising the remainder of Fe and inevitable impurities).

That is, there is no particular restriction on the method of containment for one or more of alloying elements selected from Mn, Mo, Cr, Ni, Cu and V to the iron-based powder mixture. It may be a mere mixture but it is preferably contained in the form of a partially alloyed steel powder or pre-alloyed steel powder to the iron-based metal powder. The addition forms may be used in combination.

A preferred embodiment of this further invention is to be described in details.

At first, the method up to forming the sintered iron-based powder metal body is identical with another invention described above.

Then, the sintered metal body is re-compacted into a re-compacted component.

In the re-compaction according this invention, any of known compression molding technique is applicable. That is, any of the compression molding technique described in the explanation for the compaction method is applicable. Further, since the sintered powder metal body according to this invention has a high deformability, a cold forging method can be applied. Since the cold forging method is a method which is advantageous in view of the cost and the dimensional accuracy, the cold forging method is used preferably for the re-compaction method in this invention. Further, instead of the cold forging method, other compaction method such as a roll forming method (cold compression method being preferred) may also be applied.

Then, the re-compacted component is re-sintered into a sintered body.

The re-sintering is preferably conducted in an inert gas atmosphere, a reducing atmosphere or in vacuum in order to prevent oxidation of products. Further, the re-sintering temperature is preferably within a range from about 1050 to about 1300° C. That is, when re-sintering is conducted at a temperature of about 1050° C. or higher, since sintering between each of particles proceeds sufficiently and carbon contained in the pressed body diffuses thoroughly, desired strength for the product can be ensured. Further, when re-sintering is applied at a temperature of about 1300° C. or lower, lowering of the product strength by growth of the crystal grains can be avoided. Further, the processing time for re-sintering is properly set depending on the purpose or the condition and it is usually sufficient within a range from about 600 to about 7200 s in order to obtain a desired product strength.

The sintered body is then applied with a heat treatment as necessary.

For the heat treatment, a carburization treatment, quenching treatment or tempering treatment can be selected depending on the purpose. There is no particular restriction for the heat treatment condition and any of gas carburization quenching, vacuum carburization quenching, bright quenching and induction quenching is suitable.

For example, the gas carburization quenching is preferably conducted by heating at a temperature of about 800 to about 900° C. in an atmosphere at a carbon potential of about 0.6 to about 1% and then quenching in oil. Further, the bright quenching is preferably conducted by heating at a temperature of about 800 to about 950° C. in an inert atmosphere such as Ar gas or a protective atmosphere such as a hydrogen-containing nitrogen atmosphere and then quenching in oil for preventing high temperature oxidation or decarbonization on the surface of the sintered body. Further, also the vacuum carburization quenching on induction quenching is preferably conducted by heating to the temperature range described above and then conducting quenching.

Further, tempering may be applied as necessary after the quenching treatment. The tempering temperature is preferably within a usually known quenching temperature range of from about 130 to about 250° C. The strength of the product can be improved by the heat treatment described above.

Machining may be applied before or after the heat treatment for adjusting size and shape.

Further, in this invention, there is no problem in view of characteristics such as strength and density when heat treatment is applied for the re-compacted component without re-sintering to form a product. In this invention, sintering of the preform is also referred to as preliminary sintering in a case of not applying re-sintering.

EXAMPLE

Example 1

Graphite powders and lubricants of the kinds and the contents shown in Table 1 were mixed to iron-based metal powders shown in Table 1 by a V-mixer to form iron-based powder mixtures.

For the iron-based metal powder, an iron powder A (KIP301A, manufactured by Kawasaki Steel Corporation) and a partially alloyed steel powder B were used. The iron powder A used in this example (Specimen Nos. 1-1 to 1-13, 1-15 to 1-19, 1-22 and 1-23) had an average grain size of about 75 $\mu$m, and contained 0.007 mass % C, 0.12 mass % Mn, 0.15 mass % of O and 0.0020 mass % of N and the remainder of Fe and inevitable impurities. As the impurities, 0.02 mass % Si, 0.012 mass % S and 0.014 mass % P were contained. The partially alloyed steel powder B was formed by mixing 0.9 mass % of a molybdenum oxide powder to the iron powder A, keeping the same at 875° C.×3600 s in a hydrogen atmosphere, and diffusion bonding molybdenum partially on the surface. The partially alloyed steel powder B had a composition comprising 0.007 mass % C, 0.14 mass % Mn, 0.11 mass % O, 0.0023 mass % N, 0.58 mass % Mo and the remainder of Fe and inevitable impurities. The average particle size and the content of the impurities of the iron powder B were at the level approximate to that of the iron powder A. Further, natural graphite was used for the graphite powder and zinc stearate was used for the lubricant. In Table 1, the content of the lubricant in the iron-based powder mixture is indicated by parts by weight based on 100 parts by weight for the total amount of the iron-based metal powder and the graphite powder.

The iron-based mixed powder was charged in a die, preliminarily compacted at a room temperature by a hydraulic compression molding machine into a tablet-shaped preform of 30 mmΦ×15 mm height. The density of the preform was 7.4 $Mg/m^3$. The density was adjusted to 7.1 $Mg/m^3$ for some of the specimens (Specimen Nos. 1-13, 1-23) by controlling the compaction pressure.

The thus obtained preforms were preliminarily sintered under the conditions shown in Table 1 to form sintered powder metal bodies. For some of the specimens (Specimen No. 1-15 to 1-23), annealing was conducted succeeding to the preliminary sintering continuously.

The composition, the surface hardness HRB and the amount of free graphite for the obtained sintered powder metal bodies were investigated. The results are shown in Table 2.

Further, test specimens were sampled from the sintered powder metal bodies and the entire amount of carbon, the amount of nitrogen, the amount of oxygen and the amount of free graphite were measured. The total carbon content wes measured by combustion-IR absorption method. The oxygen content was measured by inert gas fusion-IR absorption method. The nitrogen content was measured by inert gas fusion-thermal conductivity method. Further, the amount of carbon was measured for the residue obtained after dissolving the specimens sampled from the sintered powder metal body in nitric acid by combustion-IR absorption method to determine the amount of free carbon. The content of solid solubilized carbon was defined as [(total carbon content)−(free carbon content)]. In this definition, carbon forming carbides after once diffused into the iron-based matrixes upon preliminary sintering is also included in the amount of solid solubilized carbon.

Then, the thus obtained sintered powder metal bodies were cold forged (re-compacted) at an area reduction rate of 60% by a backward extrusion method into a cup-shaped component and the forging load upon the re-compaction was measured. Further, the density of the re-compacted component was measured by the Archimedes method. Further, the microstructure of the longitudinal cross section of the component (cross section of the cup wall) was observed to measure the mean pore length in the longitudinal direction along the cross section. The longitudinal direction along the cross section is the direction of the metal flow during forging. The results are also shown in Table 2.

Further, the re-compacted components were re-sintered into a sintered body. As the conditions for re-sintering, the re-compacted components were maintained in a gas atmosphere comprising 80 vol% of nitrogen and 20 vol% of hydrogen at 1140° C.×1800 s. The density of the sintered bodies was measured by the Archimedes method.

Then, after carburizing the sintered bodies in a carburizing atmosphere at a carbon potential of 1.0% at 870° C.×3600 s, they were quenched in oil at 90° C. and then applied with heat treatment of tempering at 150° C. After the heat treatment, the hardness in HRC scale and the density by the Archimedes method of the tempered bodies were measured. The results are shown in Table 2.

Table 1

| | Iron-based powder mixture | | | | | | Preliminary sintering condition | | | | Annealing condition | | | |
|---|---|---|---|---|---|---|---|---|---|---|---|---|---|---|
| | | Graphite powder | | | | Preform | Atmosphere | | | | Atmosphere | | | |
| Specimen No. | Iron-based metal powder Type** | Type | Content mass % | Lubricant* Type | Lubricant* Content pbw | Density $Mg/m^3$ | Type: vol % | Nitrogen partial pressure kPa | Temperature ° C. | Time s | Type: vol % | Nitrogen partial pressure kPa | Temperature ° C. | Time s |
| 1-1 | A | Natural graphite | 0.3 | Zinc stearate | 0.3 | 7.40 | Vacuum | $<10^{-4}$ | 700 | 1800 | — | — | — | — |
| 1-2 | A | | 0.3 | | 0.3 | 7.40 | Vacuum | $<10^{-4}$ | 900 | 1800 | — | — | — | — |
| 1-3 | A | | 0.3 | | 0.3 | 7.40 | Vacuum | $<10^{-4}$ | 1050 | 1800 | — | — | — | — |
| 1-4 | A | | 0.3 | | 0.3 | 7.40 | Hydrogen gas | $<10^{-3}$ | 1050 | 1800 | — | — | — | — |
| 1-5 | A | | 0.3 | | 0.3 | 7.40 | Hydrogen gas | $<10^{-3}$ | 1150 | 1800 | — | — | — | — |
| 1-6 | A | | 0.3 | | 0.3 | 7.40 | Hydrogen gas | $<10^{-3}$ | 1300 | 1800 | — | — | — | — |
| 1-7 | A | | 0.3 | | 0.3 | 7.40 | Hydrogen gas: 90% Nitrogen gas: 10% | 10 | 1050 | 1800 | — | — | — | — |
| 1-8 | A | | 0.3 | | 0.3 | 7.40 | Hydrogen gas: 70% Nitrogen gas: 30% | 30 | 1150 | 1800 | — | — | — | — |
| 1-9 | A | | 0.3 | | 0.3 | 7.40 | Argon gas | $<10^{-3}$ | 1050 | 1800 | — | — | — | — |
| 1-10 | A | | 0.3 | | 0.3 | 7.40 | Nitrogen gas | 101 | 1050 | 1800 | — | — | — | — |
| 1-11 | A | | 0.3 | | 0.3 | 7.40 | Hydrogen gas: 10% Nitrogen gas: 90% | 90 | 1150 | 1800 | — | — | — | — |
| 1-12 | A | | 0.6 | | 0.3 | 7.40 | Hydrogen gas | $<10^{-3}$ | 1050 | 1800 | — | — | — | — |
| 1-13 | A | | 0.3 | | 0.3 | 7.10 | Hydrogen gas | $<10^{-3}$ | 1050 | 1800 | — | — | — | — |
| 1-14 | B | | 0.3 | | 0.3 | 7.40 | Hydrogen gas | $<10^{-3}$ | 1050 | 1800 | — | — | — | — |
| 1-15 | A | | 0.3 | | 0.3 | 7.40 | Hydrogen gas: 50% Nitrogen gas: 50% | 50 | 1150 | 1800 | Hydrogen gas: 50% Nitrogen gas: 50% | 50 | 330 | 1800 |
| 1-16 | A | | 0.3 | | 0.3 | 7.40 | Hydrogen gas: 30% Nitrogen gas: 70% | 70 | 1150 | 1800 | Hydrogen gas: 30% Nitrogen gas: 70% | 70 | 420 | 1800 |
| 1-17 | A | | 0.3 | | 0.3 | 7.40 | Hydrogen gas: 10% Nitrogen gas: 90% | 90 | 1150 | 1800 | Hydrogen gas: 10% Nitrogen gas: 90% | 90 | 760 | 1800 |
| 1-18 | A | | 0.3 | | 0.3 | 7.40 | Hydrogen gas: 30% Nitrogen gas: 70% | 70 | 1150 | 1800 | Hydrogen gas: 30% Nitrogen gas: 70% | 70 | 640 | 1800 |
| 1-19 | A | | 0.3 | | 0.3 | 7.40 | Nitrogen gas: 100% | 101 | 1150 | 1800 | Nitrogen gas: 100% | 101 | 760 | 1800 |

Table 1-continued

| | Iron-based powder mixture | | | | | Pre-form | Preliminary sintering condition | | | | Annealing condition | | | |
|---|---|---|---|---|---|---|---|---|---|---|---|---|---|---|
| | Iron-based | Graphite powder | | Lubricant* | | | Atmosphere | | | | Atmosphere | | | |
| Specimen No. | metal powder Type** | Type | Content mass % | Type | Content pbw | Density Mg/m³ | Type: vol % | Nitrogen partial pressure kPa | Temperature ° C. | Time s | Type: vol % | Nitrogen partial pressure kPa | Temperature ° C. | Time s |
| 1-20 | B | | 0.3 | | 0.3 | 7.40 | Hydrogen gas: 75% Nitrogen gas: 25% | 25 | 1050 | 1800 | Hydrogen gas: 75% Nitrogen gas: 25% | 25 | 640 | 1800 |
| 1-21 | B | | 0.3 | | 0.3 | 7.40 | Hydrogen gas: 20% Nitrogen gas: 80% | 80 | 1050 | 1800 | Hydrogen gas: 20% Nitrogen gas: 80% | 80 | 550 | 1800 |
| 1-22 | A | | 0.3 | | 0.3 | 7.40 | Hydrogen gas: 30% Nitrogen gas: 70% | 70 | 900 | 1800 | Hydrogen gas: 30% Nitrogen gas: 70% | 70 | 420 | 1800 |
| 1-23 | A | | 0.3 | | 0.3 | 7.10 | Hydrogen gas: 30% Nitrogen gas: 70% | 70 | 1150 | 1800 | Hydrogen gas: 30% Nitrogen gas: 70% | 70 | 420 | 1800 |

*) Based on 100 parts by weight in total of iron-based metal powder and graphite powder
**) Powder A: C: 0.007 mass % —Mn: 0.12 mass % —O: 0.15 mass % —N: 0.0020 mass %
Powder B: Partially alloyed steel powder: C: 0.007 mass % —Mn: 0.14 mass % —O: 0.11 mass % —N: 0.0023 mass % —Mo: 0.58 mass %

TABLE 2

| | Sintered powder metal body | | | | | | | Re-compaction | Re-compacted component | | Sintered body | Sintered body after heat treatment | |
|---|---|---|---|---|---|---|---|---|---|---|---|---|---|
| | Composition (mass %) | | | | | | | Cold forging | | Mean pore | | | |
| Specimen No. | O | N | Total C | Solid solution C | Free C | Density Mg/m³ | Hardness HRB | load tonf (kN) | Density Mg/m³ | length μm | Density Mg/m³ | Density Mg/m³ | Hardness HRC |
| 1-1 | 0.13 | 0.0022 | 0.29 | 0.12 | 0.17 | 7.40 | 26 | 80 (786) | 7.69 | 50 | 7.69 | 7.69 | 31 |
| 1-2 | 0.10 | 0.0020 | 0.27 | 0.14 | 0.13 | 7.40 | 29 | 81 (794) | 7.74 | 35 | 7.74 | 7.74 | 30 |
| 1-3 | 0.08 | 0.0020 | 0.26 | 0.24 | 0.02 | 7.40 | 30 | 87 (853) | 7.81 | <10 | 7.81 | 7.81 | 32 |
| 1-4 | 0.08 | 0.0006 | 0.25 | 0.23 | 0.02 | 7.40 | 30 | 86 (843) | 7.81 | <10 | 7.81 | 7.81 | 34 |
| 1-5 | 0.07 | 0.0008 | 0.23 | 0.22 | 0.01 | 7.40 | 31 | 86 (843) | 7.82 | <10 | 7.82 | 7.82 | 35 |
| 1-6 | 0.10 | 0.0009 | 0.21 | 0.20 | 0.01 | 7.40 | 28 | 87 (853) | 7.84 | <10 | 7.84 | 7.84 | 39 |
| 1-7 | 0.08 | 0.0021 | 0.24 | 0.23 | 0.01 | 7.40 | 30 | 89 (873) | 7.81 | <10 | 7.81 | 7.82 | 36 |
| 1-8 | 0.06 | 0.0048 | 0.23 | 0.22 | 0.01 | 7.40 | 31 | 91 (892) | 7.80 | <10 | 7.80 | 7.80 | 34 |
| 1-9 | 0.08 | 0.0018 | 0.24 | 0.22 | 0.02 | 7.40 | 30 | 87 (853) | 7.81 | <10 | 7.81 | 7.81 | 33 |
| 1-10 | 0.08 | 0.0180 | 0.24 | 0.23 | 0.01 | 7.40 | 47 | 101 (990) | 7.81 | <10 | 7.81 | 7.82 | 34 |
| 1-11 | 0.06 | 0.0175 | 0.22 | 0.21 | 0.01 | 7.40 | 45 | 98 (961) | 7.82 | <10 | 7.82 | 7.82 | 33 |
| 1-12 | 0.07 | 0.0006 | 0.53 | 0.52 | 0.01 | 7.40 | 48 | 100 (981) | 7.81 | <10 | 7.81 | 7.81 | 39 |
| 1-13 | 0.08 | 0.0007 | 0.25 | 0.24 | 0.01 | 7.10 | 28 | 85 (833) | 7.76 | 53 | 7.78 | 7.78 | 32 |
| 1-14 | 0.07 | 0.0007 | 0.24 | 0.23 | 0.01 | 7.40 | 42 | 90 (883) | 7.81 | <10 | 7.81 | 7.81 | 59 |
| 1-15 | 0.08 | 0.0120 | 0.24 | 0.23 | 0.01 | 7.40 | 43 | 97 (951) | 7.80 | <10 | 7.80 | 7.80 | 33 |
| 1-16 | 0.08 | 0.0044 | 0.24 | 0.23 | 0.01 | 7.40 | 32 | 90 (883) | 7.81 | <10 | 7.81 | 7.81 | 34 |
| 1-17 | 0.07 | 0.0093 | 0.23 | 0.22 | 0.01 | 7.40 | 34 | 91 (892) | 7.81 | <10 | 7.81 | 7.81 | 33 |
| 1-18 | 0.08 | 0.0110 | 0.24 | 0.23 | 0.01 | 7.40 | 39 | 97 (951) | 7.80 | <10 | 7.80 | 7.80 | 33 |
| 1-19 | 0.09 | 0.0170 | 0.24 | 0.23 | 0.01 | 7.40 | 41 | 98 (961) | 7.81 | <10 | 7.81 | 7.81 | 34 |
| 1-20 | 0.07 | 0.0020 | 0.24 | 0.23 | 0.01 | 7.40 | 41 | 89 (872) | 7.81 | <10 | 7.81 | 7.81 | 59 |
| 1-21 | 0.07 | 0.0085 | 0.24 | 0.23 | 0.01 | 7.40 | 43 | 90 (883) | 7.81 | <10 | 7.81 | 7.80 | 60 |
| 1-22 | 0.10 | 0.0042 | 0.27 | 0.15 | 0.12 | 7.40 | 30 | 87 (853) | 7.76 | 32 | 7.76 | 7.76 | 30 |
| 1-23 | 0.07 | 0.0047 | 0.24 | 0.23 | 0.01 | 7.10 | 29 | 83 (813) | 7.77 | 54 | 7.77 | 7.77 | 31 |

It can be seen that any of the sintered powder metal bodies satisfying the constituent conditions of this invention has a high density of 7.3 Mg/m³ or more, is free from occurrence of crackings even under application of the cold forging, has high deformability, undergoes low forgting load upon the re-compaction and is excellent in the deformability. Further, each of the components satisfying the constituent conditions of this invention has a high density of 7.8 Mg/m³ or more and less number of elongate voids, and the mean length of the pore was less than 10 μm. Further, each of the sintered bodies and the sintered bodies after heat treatment of this invention showed no lowering of the density. The sintered bodies after the heat treatment showed a high hardness of HRC 32 or more even without any additional alloying elements. Particularly, examples of this invention containing molybdenum showed a further higher hardness of HRC 59 after the heat treatment. The sintered powder metal bodies annealed at a temperature in a particularly preferred range of this invention after the preliminary sintering (Specimen No. 1-16, No. 1-17, No. 1-20, No. 1-21) had a nitrogen content of 0.010 mass % or less even when the nitrogen partial pressure in the atmosphere during preliminary sintering exceeded 30 kPa so long as the partial pressure was 95 kPa or lower.

On the other hand, in the sintered powder metal bodies preliminarily sintered at a temperature below the range of this invention (Specimens Nos. 1—1, 1-2, 1-22: comparative examples), the amount of free carbon was as high as 0.17 mass % (Specimen No. 1-1), 0.13 mass % (Specimen No. 1-2) and 0.12 mass % (Specimen No. 1-22), the density of the re-compacted component was as low as less than 7.80

Mg/m$^3$, a number of pores extended lengthwise in the forging direction were observed and also the average pore length was 50 μm (Specimen No. 1-1), 35 μm (Specimen No. 1-2) and 32 μm (Specimen No. 1-22). Further, in the sintered powder metal bodies having the N-content greatly exceeding the range of this invention (Specimens No. 1-10, No. 1-11), the forging load was 101 tonf (990 kN) and 98 tonf (961 kN). Further, in the sintered powder metal body having the C content greatly exceeding the range of this invention (Specimen No. 1-12), the forging load was as high as 100 tonf (981 kN). Further, in a case where the density of the sintered powder metal body was as low as less than 7.3 Mg/m$^3$ (Specimens No. 1-13 and No. 1-23: comparative examples), the density of the re-compacted component was lower and the average pore length also increased as 53 to 54 μm. In a case where the annealing temperature after the preliminary sintering exceeded the preferred range of this invention (400 to 800° C.) (Specimen No. 1-15 and No. 1-18), nitrogen content of 0.010 mass % or less could not be attained and the forgting load was large. However, when the nitrogen content before the annealing treatment was measured separately, it was 160 ppm and 150 ppm, respectively, and the effect of reducing the nitrogen content by the annealing was provided. Further, also in a case where the nitrogen pressure in the atmosphere during preliminary sintering exceeded 95 kPa (Specimen No. 1-19, 101 kPa), the nitrogen content after the annealing after preliminary sintering exceeded 0.010 mass % and the forging load increased. However, when the nitrogen content before the annealing was measured separately, it was 220 ppm and the effect of reducing the nitrogen content by the annealing was provided.

Example 2

Graphite powders and lubricants of the kinds and the contents shown in Table 3 were mixed to iron-based metal powders shown in Table 3 by a corn-type mixer to form iron-based powder mixtures.

For the iron-based metal powder, a partially alloyed steel powder C formed by partially alloying Ni and Mo on the surface of iron powder A particles through the same process as in Example 1 was used. The composition of the partially alloyed steel powder C contained 0.003 mass % C, 0.08 mass % Mn, 0.09 mass % O, 0.0020 mass % N, 2.03 mass % Ni and 1.05 mass % Mo. Further, natural graphite was used for the graphite powder and one of zinc stearate, lithium stearate and ethylene bisstearoamide was used as the lubricant. In Table 3, the content of the lubricant in the iron-based powder mixture is indicated by parts by weight based on 100 parts by weight for the total amount of the iron-based metal powder and the graphite powder.

The iron-based mixed powder was charged in a die, compacted at the room temperature by a hydraulic press into a tablet-shaped preform of 30 mmΦ×15 mm height. The density of the preform was 7.4 Mg/m$^3$. The density was 7.1 Mg/m$^3$ for some of the specimens (Specimen No. 2-12) by controlling the compaction pressure.

The thus obtained preform was preliminarily sintered under the conditions shown in Table 3 to form a sintered powder metal body. Some of the specimens (Specimen No. 2-15 to 2-21), were annealed after the preliminary sintering.

The composition, the surface hardness in HRB scale and the of free carbon content for the obtained sintered powder metal body were measured. The results are shown in Table 4.

The total carbon content, the nitrogen content, the oxygen content and the free carbon content were measured by using the test specimens sampled from the sintered powder metal body in the same manner as in Example 1. The content of solid solubilized carbon was calculated based on the total carbon and the free carbon content in the same manner as in Example 1.

Then, the thus obtained sintered powder metal bodies were cold forged (re-compacted) at an area reduction rate of 80% by a backward extrusion method into a cup-shaped re-compacted component and the forging load upon re-compaction was measured. Further, the density of the re-compacted component was measured by the Archimedes method. Further, the microstructure of the longitudinal cross section of the re-compacted component (cross section for cup wall) was observed to measure the mean pore length in the longitudinal direction along the cross section. The longitudinal direction along the cross section is the direction of the metal flow during forging. The results are also shown in Table 4.

Further, the re-compacted component was re-sintered into a sintered body. As the conditions for re-sintering, the re-compacted component was kept in a gas atmosphere comprising 80 vol% of nitrogen and 20 vol% of hydrogen at 1140° C.×1800 s in the same manner as in Example 1. The density of the sintered bodies was measured by the Archimedes method.

Then, after carburizing the sintered bodies in a carburizing atmosphere at a carbon potential of 1.0% at 870° C.×3600 s, they were quenched in oil at 90° C. and then applied to a heat treatment for tempering at 150° C. in the same manner as in Example 1. After the heat treatment, the hardness in HRC scale and the density by the Archimedes method of the sintered bodies were measured. The results are shown in Table 4.

TABLE 3

| | Iron-based powder mixture | | | | | Preform | Preliminary sintering condition | | | | Annealing condition | | | |
|---|---|---|---|---|---|---|---|---|---|---|---|---|---|---|
| | Iron-based metal powder | Graphite powder | | Lubricant* | | | Atmosphere | | | | Atmosphere | | | |
| Specimen No. | Type ** | Type | Content mass % | Type | Content pbw | Density Mg/m$^3$ | Type: vol % | Nitrogen partial pressure kPa | Temperature ° C. | Time s | Type: vol % | Nitrogen partial pressure kPa | Temperature ° C. | Time s |
| 2-1 | C | Natural graphite | 0.3 | Zinc stearate | 0.3 | 7.40 | Vacuum | $<10^{-4}$ | 700 | 1800 | — | — | — | — |
| 2-2 | | | 0.3 | | 0.3 | 7.40 | Vacuum | $<10^{-4}$ | 900 | 1800 | — | — | — | — |
| 2-3 | | | 0.3 | | 0.3 | 7.40 | Vacuum | $<10^{-4}$ | 1050 | 1800 | — | — | — | — |

TABLE 3-continued

| Specimen No. | Iron-based powder mixture: Iron-based metal powder Type ** | Graphite powder Type | Graphite powder Content mass % | Lubricant* Type | Lubricant* Content pbw | Pre-form Density Mg/m³ | Preliminary sintering condition: Atmosphere Type: vol % | Preliminary sintering condition: Atmosphere Nitrogen partial pressure kPa | Preliminary sintering condition: Temperature ° C. | Preliminary sintering condition: Time s | Annealing condition: Atmosphere Type: vol % | Annealing condition: Atmosphere Nitrogen partial pressure kPa | Annealing condition: Temperature ° C. | Annealing condition: Time s |
|---|---|---|---|---|---|---|---|---|---|---|---|---|---|---|
| 2-4 | | | 0.3 | | 0.3 | 7.40 | Hydrogen gas | $<10^{-3}$ | 1050 | 1800 | — | — | — | — |
| 2-5 | | | 0.3 | | 0.3 | 7.40 | Hydrogen gas | $<10^{-3}$ | 1150 | 1800 | — | — | — | — |
| 2-6 | | | 0.3 | | 0.3 | 7.40 | Hydrogen gas | $<10^{-3}$ | 1300 | 1800 | — | — | — | — |
| 2-7 | | | 0.3 | | 0.3 | 7.40 | Hydrogen gas: 85% Nitrogen gas: 15% | 15 | 1050 | 1800 | — | — | — | — |
| 2-8 | | | 0.3 | | 0.3 | 7.40 | Argon gas | $<10^{-3}$ | 1050 | 1800 | — | — | — | — |
| 2-9 | | | 0.3 | | 0.3 | 7.40 | Nitrogen gas | 101 | 1050 | 1800 | — | — | — | — |
| 2-10 | | | 0.3 | | 0.3 | 7.40 | Hydrogen gas: 10% Nitrogen gas: 90% | 90 | 1150 | 1800 | — | — | — | — |
| 2-11 | | | 0.6 | | 0.3 | 7.40 | Hydrogen gas | $<10^{-3}$ | 1050 | 1800 | — | — | — | — |
| 2-12 | | | 0.3 | | 0.3 | 7.10 | Hydrogen gas | $<10^{-3}$ | 1050 | 1800 | — | — | — | — |
| 2-13 | | | 0.3 | Lithium stearate | 0.3 | 7.40 | Hydrogen gas: 85% Nitrogen gas: 15% | 15 | 1050 | 1800 | — | — | — | — |
| 2-14 | | | 0.3 | Ethylene bis-stearo-amide | 0.3 | 7.40 | Hydrogen gas: 85% Nitrogen gas: 15% | 15 | 1050 | 1800 | — | — | — | — |
| 2-15 | | | 0.3 | Zinc stearate | 0.3 | 7.40 | Hydrogen gas: 10% Nitrogen gas: 90% | 90 | 1150 | 1800 | Hydrogen gas: 10% Nitrogen gas: 90% | 90 | 600 | 1800 |
| 2-16 | | | 0.3 | Zinc stearate | 0.3 | 7.40 | Hydrogen gas: 20% Nitrogen gas: 80% | 80 | 1050 | 3600 | Hydrogen gas: 30% Nitrogen gas: 70% | 70 | 700 | 1200 |
| 2-17 | | | 0.3 | Zinc stearate | 0.3 | 7.40 | Hydrogen gas: 30% Nitrogen gas: 70% | 70 | 1200 | 1200 | Hydrogen gas: 10% Nitrogen gas: 90% | 90 | 650 | 2400 |
| 2-18 | | | 0.3 | Lithium stearate | 0.3 | 7.40 | Hydrogen gas: 10% Nitrogen gas: 90% | 90 | 1150 | 1800 | Hydrogen gas: 10% Nitrogen gas: 90% | 90 | 600 | 1800 |
| 2-19 | | | 0.3 | Ethylene bis-stearo-amide | 0.3 | 7.40 | Hydrogen gas: 10% Nitrogen gas: 90% | 90 | 1150 | 1800 | Hydrogen gas: 10% Nitrogen gas: 90% | 90 | 600 | 1800 |
| 2-20 | | | 0.3 | Zinc stearate | 0.3 | 7.40 | Hydrogen gas: 10% Nitrogen gas: 90% | 90 | 1150 | 1800 | Hydrogen gas: 2% Nitrogen gas: 98% | 98 | 600 | 1800 |
| 2-21 | | | 0.6 | Zinc stearate | 0.3 | 7.40 | Hydrogen gas: 10% Nitrogen gas: 90% | 90 | 1150 | 1800 | Hydrogen gas: 10% Nitrogen gas: 90% | 90 | 600 | 1800 |

*) Based on 100 parts by weight in total of iron-based metal powder and graphite powder

**) Powder C: Partially alloyed steel powder: C: 0.003 mass % —Mn: 0.08 mass % —O: 0.09 mass % —N: 0.0020 mass % —Ni: 2.03 mass % —Mo: 1.05 mass %

TABLE 4

| Specimen No. | Sintered powder metal body: Composition (mass %) O | N | Total C | Solid solution C | Free C | Density Mg/m³ | Hardness HRB | Re-compaction: Cold forging load tonf (kN) | Re-compacted component: Density Mg/m³ | Re-compacted component: Mean void length μm | Sintered body: Density Mg/m³ | Sintered body after heat treatment: Density Mg/m³ | Sintered body after heat treatment: Hardness HRC |
|---|---|---|---|---|---|---|---|---|---|---|---|---|---|
| 2-1 | 0.12 | 0.0023 | 0.29 | 0.01 | 0.28 | 7.40 | 40 | 140 (1372) | 7.64 | 52 | 7.64 | 7.64 | 59 |
| 2-2 | 0.10 | 0.0021 | 0.29 | 0.09 | 0.20 | 7.40 | 41 | 145 (1442) | 7.72 | 38 | 7.73 | 7.73 | 60 |
| 2-3 | 0.08 | 0.0019 | 0.23 | 0.22 | 0.01 | 7.40 | 43 | 155 (1520) | 7.80 | <10 | 7.80 | 7.80 | 60 |
| 2-4 | 0.08 | 0.0006 | 0.24 | 0.23 | 0.01 | 7.40 | 42 | 164 (1608) | 7.81 | <10 | 7.81 | 7.81 | 60 |
| 2-5 | 0.06 | 0.0007 | 0.23 | 0.22 | 0.01 | 7.40 | 41 | 165 (1618) | 7.82 | <10 | 7.82 | 7.82 | 62 |
| 2-6 | 0.04 | 0.0009 | 0.21 | 0.20 | 0.01 | 7.40 | 41 | 166 (1628) | 7.83 | <10 | 7.83 | 7.83 | 60 |
| 2-7 | 0.09 | 0.0043 | 0.24 | 0.23 | 0.01 | 7.40 | 46 | 172 (1687) | 7.82 | <10 | 7.82 | 7.82 | 61 |
| 2-8 | 0.08 | 0.0018 | 0.24 | 0.23 | 0.01 | 7.40 | 43 | 163 (1598) | 7.81 | <10 | 7.82 | 7.82 | 61 |
| 2-9 | 0.08 | 0.0240 | 0.24 | 0.23 | 0.01 | 7.40 | 61 | Not forgeable to a predetermined shape | | | | | |
| 2-10 | 0.07 | 0.0220 | 0.22 | 0.21 | 0.01 | 7.40 | 60 | Not forgeable to a predetermined shape | | | | | |
| 2-11 | 0.08 | 0.0006 | 0.54 | 0.53 | 0.01 | 7.40 | 62 | Not forgeable to a predetermined shape | | | | | |
| 2-12 | 0.08 | 0.0007 | 0.25 | 0.24 | 0.01 | 7.10 | 41 | 162 (1589) | 7.78 | 48 | 7.78 | 7.78 | 60 |
| 2-13 | 0.09 | 0.0042 | 0.24 | 0.23 | 0.01 | 7.40 | 46 | 172 (1687) | 7.82 | <10 | 7.82 | 7.82 | 61 |
| 2-14 | 0.09 | 0.0042 | 0.24 | 0.23 | 0.01 | 7.40 | 47 | 172 (1676) | 7.81 | <10 | 7.81 | 7.81 | 61 |

TABLE 4-continued

| Specimen No. | Sintered powder metal body: Composition (mass %) O | N | Total C | Solid solution C | Free C | Density Mg/m³ | Hardness HRB | Re-compaction: Cold forging load tonf (kN) | Re-compacted component: Density Mg/m³ | Mean void length μm | Sintered body: Density Mg/m³ | Sintered body after heat treatment: Density Mg/m³ | Hardness HRC |
|---|---|---|---|---|---|---|---|---|---|---|---|---|---|
| 2-15 | 0.07 | 0.0092 | 0.24 | 0.23 | 0.01 | 7.40 | 50 | 174 (1705) | 7.80 | <10 | 7.80 | 7.80 | 60 |
| 2-16 | 0.08 | 0.0083 | 0.24 | 0.23 | 0.01 | 7.40 | 49 | 171 (1676) | 7.80 | <10 | 7.80 | 7.80 | 60 |
| 2-17 | 0.07 | 0.0076 | 0.25 | 0.24 | 0.01 | 7.41 | 49 | 173 (1695) | 7.81 | <10 | 7.80 | 7.80 | 60 |
| 2-18 | 0.07 | 0.0094 | 0.24 | 0.23 | 0.01 | 7.40 | 50 | 174 (1705) | 7.81 | <10 | 7.81 | 7.81 | 60 |
| 2-19 | 0.08 | 0.0093 | 0.25 | 0.23 | 0.01 | 7.40 | 49 | 173 (1695) | 7.80 | <10 | 7.80 | 7.80 | 60 |
| 2-20 | 0.07 | 0.0098 | 0.24 | 0.23 | 0.01 | 7.40 | 50 | 174 (1705) | 7.80 | <10 | 7.80 | 7.80 | 60 |
| 2-21 | 0.07 | 0.0092 | 0.53 | 0.52 | 0.01 | 7.40 | 63 | Not forgeable to a predetermined shape | | | | | |

It can be seen that any of the sintered powder metal bodies satisfying the constituent conditions of this invention has a high density of 7.3 Mg/m$^3$ or more, is free from occurrence of crackings even under application of the cold forging, has high deformability, undergoes low forging load upon the re-compaction, is excellent in the deformability and forgeable. Further, each of the re-compacted components satisfying the constituent conditions of this invention has a high density of 7.80 Mg/m$^3$ or more and less number of elongate pores, and the average length of the pore was less than 10 μm. Further, each of the sintered bodies and the sintered bodies after the heat treatment of this invention showed no lowering of the density. The sintered body after the heat treatment showed a high hardness of HRC 60 or more.

When the Specimen No. 2-15, Nos. 2-18 to 2-21 are compared with the Specimen No. 2-10, it can be seen that the nitrogen content of the sintered powder metal body is remarkably lowered by the appropriate annealing. The effect of reducing the nitrogen content is reduced somewhat in a case where the nitrogen partial pressure in the atmosphere during annealing is about 98 kPa (Specimen No. 2-20).

On the other hand, in the sintered powder metal body preliminarily sintered at a temperature below the range of this invention (Specimens No. 2-1, Specimen No. 2—2: comparative examples), the free carbon content was as high as 0.28 mass % (Specimen No. 2-1), and 0.20 mass % (Specimen No. 2-2), crackings were formed during cold forging the density of the re-compacted component was as low as less than 7.80 Mg/m$^3$, a number of pores extended lengthwise in the forging direction were observed and also the mean pore length was 52 μm (Specimen No. 2-1) and 38 μm (Specimen No. 2-2). Further, in the sintered powder metal bodies having the nitrogen content greatly exceeding the range of this invention (Specimens No. 2-9, No. 2-10), and in the sintered powder metal bodies having the C content greatly exceeding the range of this invention (Specimen Nos. 2-11, 2-21), the hardness of the sintered powder metal body was high and the deformability was low and it could not be forged to a predetermined shape.

Further, in a case where the density of the sintered powder metal body was as low as less than 7.3 Mg/m$^3$ (Specimens No. 2-12), the density of the re-compacted component was lower and the mean pore length also increased as 48 μm.

Example 3

Graphite powders and lubricants of the kinds and the contents shown in Table 5 were mixed to iron-based metal powders shown in Table 5 by a corn-type mixer to form iron-based powder mixtures.

For the iron-based metal powder, a pre-alloyed steel powder D formed by a water atomizing method (KIP5MOS, manufactured by Kawasaki Steel Corporation) was used. The composition of the pre-alloyed steel powder D comprised 0.004 mass % C, 0.20 mass % Mn, 0.11 mass % 0, 0.0021 mass % N and 0.60 mass % Mo and the remainder of Fe and inevitable impurities. As the imparities, 0.02 mass % Si, 0.006 mass % S and 0.015 mass % P were contained. The average particle size of the powder D was about 89 μm. Further, natural graphite was used for the graphite powder and zinc stearate was used for the lubricant.

In Table 5, the content of the lubricant in the iron-based powder mixture is indicated by parts by weight based on 100 parts by weight in total for the iron-based metal powder and the graphite powder.

The iron-based mixed powder was charged in a die, compacted at the room temperature by a hydraulic press into a tablet-shaped preform of 30 mmΦ×15 mm height. The density of the preform was 7.4 Mg/m$^3$. The density was 7.1 Mg/m$^3$ for some of the specimens (Specimen No. 3-12) by controlling the compaction pressure.

The thus obtained preform was preliminarily sintered under the conditions shown in Table 5 to form a sintered powder metal body. Some of the specimens (Specimen No. 3-12, No. 3-14, Nos. 3-17 to 3-20), were annealed in continuous with the preliminary sintering.

Among them, for the Specimen No. 3-18 was not kept at an annealing temperature and the specimen was gradually cooled from 800° C. to 400° C. and stayed in this temperature zone longer by 3600 s than the standard cooling time for this temperature zone (2400 s). Further, Specimen No. 3-21 was annealed separately from the preliminary sintering.

The composition, the surface hardness in HRB scale and the free carbon content for the obtained sintered powder metal bodies were measured. The results are shown in Table 6.

The total carbon content, the nitrogen content, the oxygen content and the free carbon content were measured by using the test specimens sampled from the sintered powder metal bodies in the same manner as in Example 1. The content of solid solubilized carbon was calculated based on the total carbon content and the free carbon content in the same manner as in Example 1.

Then, the thus obtained sintered powder metal bodies were cold forged (re-compacted) at an area reduction rate of 80% by a backward extrusion method into a cup-shaped re-compacted component and the forging load upon the re-compaction was measured. Further, the density of the re-compacted component was measured by the Archimedes method. Further, the microstructure of the longitudinal cross section of the resultant re-compacted component (cross section for cup wall) was observed to measure the mean pore length in the longitudinal direction along the cross section as in Example 1. The longitudinal direction along the cross section is the direction of the metal flow during forging. The results are also shown in Table 6.

Further, the re-compacted component was re-sintered into a sintered body. As the conditions for re-sintering, the re-compacted component was maintained in a gas atmosphere comprising 80 vol% of nitrogen and 20 vol% of hydrogen at 1140° C.×1800 s as in the same manner in the Example 1. The density of the sintered bodies was measured by the Archimedes method.

Then, after carburizing the sintered bodies in a carburizing atmosphere at a carbon potential of 1.0% at 870° C.×3600 s, they were quenched in oil at 90° C. and then applied with heat treatment of tempering at 150° C. as in the same manner in the Example 1. After the heat treatment, the hardness in HRC scale and the density by the Archimedes method of the sintered bodies were measured. The results are shown in Table 6.

TABLE 5

| | Iron-based powder mixture | | | | | | Preliminary sintering condition | | | | Annealing condition | | | |
|---|---|---|---|---|---|---|---|---|---|---|---|---|---|---|
| | Iron-based metal powder | Graphite powder | | Lubricant* | | Pre-form Density | Atmosphere | | | | Atmosphere | | | |
| Specimen No. | Type ** | Type | Content mass % | Type | Content pbw | Mg/m³ | Type: vol % | Nitrogen partial pressure kPa | Temperature ° C. | Time s | Type: vol % | Nitrogen partial pressure kPa | Temperature ° C. | Time s |
| 3-1 | D | Natural graphite | 0.2 | Zinc stearate | 0.2 | 7.40 | Vacuum | $<10^{-4}$ | 700 | 1800 | — | — | — | — |
| 3-2 | | | 0.2 | | 0.2 | 7.40 | Vacuum | $<10^{-4}$ | 900 | 1800 | — | — | — | — |
| 3-3 | | | 0.2 | | 0.2 | 7.40 | Vacuum | $<10^{-4}$ | 1050 | 1800 | — | — | — | — |
| 3-4 | | | 0.2 | | 0.2 | 7.40 | Hydrogen gas | $<10^{-3}$ | 1050 | 1800 | — | — | — | — |
| 3-5 | | | 0.2 | | 0.2 | 7.40 | Hydrogen gas | $<10^{-3}$ | 1150 | 1800 | — | — | — | — |
| 3-6 | | | 0.2 | | 0.2 | 7.40 | Hydrogen gas | $<10^{-3}$ | 1300 | 1800 | — | — | — | — |
| 3-7 | | | 0.2 | | 0.2 | 7.40 | Hydrogen gas: 90% Nitrogen gas: 10% | 10 | 1050 | 1800 | — | — | — | — |
| 3-8 | | | 0.2 | | 0.2 | 7.40 | Argon gas | $<10^{-3}$ | 1050 | 1800 | — | — | — | — |
| 3-9 | | | 0.2 | | 0.2 | 7.40 | Nitrogen gas | 101 | 1050 | 1800 | — | — | — | — |
| 3-10 | | | 0.2 | | 0.2 | 7.40 | Hydrogen gas: 50% Nitrogen gas: 50% | 50 | 1150 | 1800 | — | — | — | — |
| 3-11 | | | 0.6 | | 0.2 | 7.40 | Hydrogen gas | $<10^{-3}$ | 1050 | 1800 | — | — | — | — |
| 3-12 | | | 0.2 | | 0.2 | 7.10 | Hydrogen gas | $<10^{-3}$ | 1050 | 1800 | — | — | — | — |
| 3-13 | | | 0.2 | | 0.2 | 7.40 | Hydrogen gas: 75% Nitrogen gas: 25% | 25 | 1050 | 1800 | Hydrogen gas: 75% Nitrogen gas: 25% | 25 | 650 | 1800 |
| 3-14 | | | 0.2 | | 0.2 | 7.40 | Hydrogen gas: 50% Nitrogen gas: 50% | 50 | 1050 | 1800 | Hydrogen gas: 50% Nitrogen gas: 50% | 50 | 600 | 1800 |
| 3-15 | | | 0.2 | | 0.2 | 7.40 | Hydrogen gas: 10% Nitrogen gas: 90% | 90 | 1050 | 1800 | — | — | — | — |
| 3-16 | | | 0.2 | | 0.2 | 7.40 | Hydrogen gas: 1% Nitrogen gas: 99% | 99 | 1050 | 1800 | — | — | — | — |
| 3-17 | | | 0.2 | | 0.2 | 7.40 | Hydrogen gas: 10% Nitrogen gas: 90% | 90 | 1050 | 1800 | Hydrogen gas: 10% Nitrogen gas: 90% | 90 | 650 | 1800 |
| 3-18 | | | 0.2 | | 0.2 | 7.40 | Hydrogen gas: 10% Nitrogen gas: 90% | 90 | 1050 | 1800 | Hydrogen gas: 10% Nitrogen gas: 90% | 90 | 400–800 | 3600 |
| 3-19 | | | 0.2 | | 0.2 | 7.40 | Hydrogen gas: 10% Nitrogen gas: 90% | 90 | 1050 | 1800 | Hydrogen gas: 10% Nitrogen gas: 90% | 90 | 350 | 2400 |
| 3-20 | | | 0.2 | | 0.2 | 7.40 | Hydrogen gas: 10% Nitrogen gas: 90% | 90 | 1050 | 1800 | Hydrogen gas: 10% Nitrogen gas: 90% | 90 | 650 | 450 |
| 3-21 | | | 0.2 | | 0.2 | 7.40 | Hydrogen gas: 1% Nitrogen gas: 99% | 99 | 1050 | 1800 | Hydrogen gas: 10% Nitrogen gas: 90% | 90 | 650 | 1800 |

*) Based on 100 parts by weight in total of iron-based metal powder and graphite powder

**) Powder D: Partially alloyed steel powder: C: 0.004 mass % —Mn: 0.20 mass % —O: 0.11 mass % —N: 0.0021 mass % —Mo: 0.60 mass %

TABLE 6

| | Sintered powder metal body | | | | | | | Re-compaction | Re-compacted component | | Sintered body | Sintered body after heat treatment | | Heat treated body/no re-sintering |
|---|---|---|---|---|---|---|---|---|---|---|---|---|---|---|
| | Composition (mass %) | | | | | | | | | | | | | |
| Specimen No. | O | N | Total C | Solid solution C | Free C | Density Mg/m³ | Hardness HRB | Cold forging molding load tonf (kN) | Density Mg/m³ | Mean pore length μm | Density Mg/m³ | Density Mg/m³ | Hardness HRC | Hardness HRC |
| 3-1 | 0.14 | 0.0023 | 0.20 | 0.01 | 0.19 | 7.40 | 37 | 135 (1324) | 7.69 | 48 | 7.70 | 7.70 | 58 | — |
| 3-2 | 0.12 | 0.0021 | 0.20 | 0.06 | 0.14 | 7.40 | 39 | 140 (1373) | 7.76 | 25 | 7.76 | 7.76 | 60 | — |
| 3-3 | 0.08 | 0.0019 | 0.17 | 0.16 | 0.01 | 7.40 | 41 | 150 (1471) | 7.82 | <10 | 7.82 | 7.83 | 60 | 60 |
| 3-4 | 0.09 | 0.0006 | 0.18 | 0.17 | 0.01 | 7.40 | 40 | 159 (1559) | 7.82 | <10 | 7.82 | 7.82 | 61 | 60 |

TABLE 6-continued

| Specimen No. | Sintered powder metal body: Composition (mass %) O | N | Total C | Solid solution C | Free C | Density Mg/m³ | Hardness HRB | Re-compaction: Cold forging molding load tonf (kN) | Re-compacted component: Density Mg/m³ | Mean pore length μm | Sintered body Density Mg/m³ | Sintered body after heat treatment: Density Mg/m³ | Hardness HRC | Heat treated body/no re-sintering Hardness HRC |
|---|---|---|---|---|---|---|---|---|---|---|---|---|---|---|
| 3-5 | 0.07 | 0.0007 | 0.17 | 0.16 | 0.01 | 7.40 | 38 | 159 (1559) | 7.83 | <10 | 7.83 | 7.83 | 62 | 61 |
| 3-6 | 0.05 | 0.0009 | 0.15 | 0.14 | 0.01 | 7.40 | 38 | 161 (1579) | 7.84 | <10 | 7.84 | 7.84 | 60 | 59 |
| 3-7 | 0.08 | 0.0040 | 0.16 | 0.17 | 0.01 | 7.40 | 45 | 157 (1540) | 7.82 | <10 | 7.82 | 7.82 | 60 | 60 |
| 3-8 | 0.07 | 0.0018 | 0.18 | 0.17 | 0.01 | 7.40 | 40 | 158 (1549) | 7.82 | <10 | 7.82 | 7.82 | 61 | 60 |
| 3-9 | 0.08 | 0.0180 | 0.18 | 0.17 | 0.01 | 7.40 | 58 | Not forgeable to a predetermined shape | | | | | | |
| 3-10 | 0.06 | 0.0148 | 0.17 | 0.16 | 0.01 | 7.40 | 50 | Not forgeable to a predetermined shape | | | | | | |
| 3-11 | 0.07 | 0.0006 | 0.53 | 0.52 | 0.01 | 7.40 | 58 | Not forgeable to a predetermined shape | | | | | | |
| 3-12 | 0.08 | 0.0007 | 0.18 | 0.17 | 0.01 | 7.10 | 39 | 157 (1540) | 7.77 | 48 | 7.77 | 7.77 | 60 | — |
| 3-13 | 0.08 | 0.0030 | 0.17 | 0.16 | 0.01 | 7.40 | 40 | 158 (1549) | 7.82 | <10 | 7.82 | 7.82 | 60 | 60 |
| 3-14 | 0.08 | 0.0068 | 0.17 | 0.16 | 0.01 | 7.40 | 43 | 161 (1579) | 7.82 | <10 | 7.82 | 7.82 | 61 | 60 |
| 3-15 | 0.07 | 0.0165 | 0.17 | 0.16 | 0.01 | 7.40 | 57 | Not forgeable to a predetermined shape | | | | | | |
| 3-16 | 0.08 | 0.0175 | 0.18 | 0.17 | 0.01 | 7.40 | 58 | Not forgeable to a predetermined shape | | | | | | |
| 3-17 | 0.07 | 0.0084 | 0.17 | 0.16 | 0.01 | 7.10 | 46 | 164 (1607) | 7.81 | <10 | 7.81 | 7.81 | 60 | — |
| 3-18 | 0.07 | 0.0090 | 0.17 | 0.16 | 0.01 | 7.40 | 47 | 166 (1627) | 7.80 | <10 | 7.80 | 7.80 | 60 | — |
| 3-19 | 0.07 | 0.0120 | 0.17 | 0.16 | 0.01 | 7.40 | 52 | Not forgeable to a predetermined shape | | | | | | — |
| 3-20 | 0.07 | 0.0096 | 0.17 | 0.16 | 0.01 | 7.40 | 48 | 165 (1617) | 7.80 | <10 | 7.80 | 7.80 | 60 | — |
| 3-21 | 0.07 | 0.0120 | 0.17 | 0.16 | 0.01 | 7.40 | 51 | Not forgeable to a predetermined shape | | | | | | |

It can be seen that any of the sintered powder metal body satisfying the constituent conditions of this invention has a high density of 7.3 Mg/m³ or more, is free from occurrence of crackings even under application of the cold forging, has high deformability, undergoes low forging load upon the re-compaction, is excellent in the deformability and forgeable. Further, each of the re-compacted component satisfying the constituent conditions of this invention has a high density of 7.80 Mg/m³ or more and less number of elongate pores, and the average pore length was less than 10 μm. Further, each of the sintered bodies and the sintered bodies after the heat treatment of this invention showed no lowering of the density. The sintered body after the heat treatment showed a high hardness of HRC 60 or more.

When the Specimen Nos. 3-17 to 3-20 were compared with the Specimen No. 3-15, it can be seen that the nitrogen content of the sintered powder metal body is remarkably lowered by the appropriate annealing. The effect of reducing the nitrogen content is reduced in a case where the nitrogen partial pressure in the atmosphere during annealing is about 98 kPa (Specimen No. 3-19).

In a case where the annealing temperature is lower than the preferred temperature (Specimen No. 3-19), the effect of decreasing nitrogen is lowered. In the specimen (Specimen No. 3-19), the nitrogen content in the sintered powder metal body exceeded 100 ppm and cold forging could not be conducted. However, when the result of hot forging applied separately under substantially the same conditions was investigated, the average pore length of the re-compacted component was less than 10 μm.

Further, compared with the case where the annealing time was shorter than the preferred condition (Specimen No. 3-20), the effect of reducing nitrogen was somewhat higher in the case of satisfying the preferred condition (Specimen No. 3-17).

In the Specimen No. 3-21 preliminarily sintered at a nitrogen partial pressure of 99 kPa and then annealed, the nitrogen content in the sintered powder metal body was reduced compared with the not annealed Specimen No. 3-16. In the specimen (Specimen No. 3-21) had the nitrogen content in the sintered powder metal body exceeding 100 ppm and could not be cold forged but the average pore length in the re-compacted component was less than 10 μm when examining the result of hot forging applied separately substantially under the same conditions.

On the other hand, in the sintered powder metal bodies preliminarily sintered at a temperature below the range of this invention (Specimens No. 3-1, Specimen No. 3-2: comparative example), the free carbon content was as high as 0.19 mass % (Specimen No. 3-1), and 0.14 mass % (Specimen No. 3-2), crackings were formed during cold forging, the density of the re-compacted component was as low as less than 7.80 Mg/m³, a number of pores extended lengthwise in the forging direction were observed, and also the average pore length was 48 μm (Specimen No. 3-1) and 25 μm (Specimen No. 3-2). Further, in the sintered powder metal body having the nitrogen content greatly exceeding the range of this invention (Specimens No. 3-9, No. 3-10, No. 3-15 and No. 3-16) and in the sintered powder metal body having the C content greatly exceeding the range of this invention (Specimen No. 3-11), the hardness of the sintered powder metal body was high and the deformation resistance was excessively high and it could not be forged to a predetermined shape.

Further, in a case where the density of the sintered powder metal body was as low as less than 7.3 Mg/m³ (Specimens No. 3-12: comparative example), the density of the re-compacted component was lower and the average pore length also increased as 48 μm.

Further, some of the re-compacted component of the invention (Specimens No. 3—3 to No. 3-8, No. 3-13 and No. 3-14) were heat treated directly without re-sintering into heat treated bodies. The hardness in HRC scale and the density were measured. The heat treatment was applied by carburization under the condition of keeping at 870° C.×3600 s in a carburizing atmosphere at a carbon potential of 1.0%, then quenching in oil at 90° C. and then tempering at 150° C. The hardness in HRC scale was measured also for the heat treated bodies. The results are shown together in Table 6. It can be seen that products of high hardness can be manufactured even without re-sintering.

Example 4

Pre-alloyed steel powder with the content of the alloying elements shown in Table 7 (iron-based metal powder, average particle size: 60–80 μm) was manufactured by a water atomizing method. It was confirmed that the content of elements other than the alloying elements shown in Table 7 were 0.03 mass % or less of C, from 0.08 to 0.15 mass % of O and 0.0025 mass % or less of N by the same method as in Example 1.

The graphite powders and the lubricants of the types and the contents shown in Table 8 were mixed to the iron-based metal powders (pre-alloyed steel powders) in a V-mixer to form an iron based powder mixtures.

Further, natural graphite was used for the graphite powder and zinc stearate was used for the lubricant.

In Table 8, the content of the lubricant in the iron-based powder mixture is indicated by parts by weight based on 100 parts by weight in total for the iron-based metal powder and the graphite powder.

The iron-based powder mixtures were charged in a die, compacted at the room temperature by a hydraulic press into a tablet-shaped preform of 30 mmΦ×15 mm height. The density of the preform was 7.4 $Mg/m^3$.

The thus obtained preform was preliminarily sintered under the conditions shown in Table 8 to form a sintered powder metal body. Some specimens (Specimen Nos. 4-15 to 4-22) were annealed continuously with the preliminary sintering. The composition, the surface hardness in HRB scale and the free carbon content for the obtained sintered powder metal body were measured. The results are shown in Table 9.

The total carbon content, the nitrogen content, the oxygen content and the free carbon content were measured by using the test specimens sampled from the sintered powder metal bodies in the same manner as in Example 1. The content of solid solubilized carbon was calculated based on the total carbon content and the free carbon content in the same manner as in Example 1.

Then, in the same manner in the Example 2 the thus obtained sintered powder metal body was cold forged (re-compacted) at an area reduction rate of 80% by a backward extrusion method into a cup-shaped re-compacted component and the forging load upon the re-compaction was measured. Further, the density of the re-compacted component was measured by the Archimedes method. Further, the microstructure of the longitudinal cross section of the re-compacted component (cross section for cup wall) was observed to measure the average pore length in the longitudinal direction along the cross section as in Example 2. The longitudinal direction along the cross section is the direction of the metal flow during forging. The results are also shown in Table 9.

Further, the re-compacted component was re-sintered to obtain a sintered body. As the conditions for re-sintering, the re-compacted component was kept in a gas atmosphere comprising 80 vol% of nitrogen and 20 vol% of hydrogen at 1140° C.×1800 s in the same manner as in Example 1. The density of the sintered bodies was measured by the Archimedes method.

Then, in the same manner in the Example 1 after carburizing the sintered bodies in a carburizing atmosphere at a carbon potential of 1.0% at 870° C.×3600 s, they were quenched in oil at 90° C. and then applied with heat treatment of tempering at 150° C. After the heat treatment, the hardness in HRC scale and the density by the Archimedes method of the sintered bodies were measured. The results are shown in Table 9.

TABLE 7

| Iron-based metal powder | Alloying element content (mass %) | | | | | |
|---|---|---|---|---|---|---|
| | Mo | Mn | Cr | Ni | Cu | V |
| E-1 | 0.54 | 0.38 | — | — | — | — |
| E-2 | 1.50 | 0.25 | — | — | — | — |
| E-3 | 0.29 | 0.72 | 1.02 | — | — | — |
| E-4 | 0.30 | 0.20 | — | 1.08 | 0.30 | — |
| E-5 | 0.31 | 0.10 | 2.84 | — | — | 0.29 |
| E-6 | 0.20 | 0.20 | — | — | 1.80 | — |
| E-7 | — | 0.11 | 0.50 | — | — | 0.80 |
| E-8 | 0.20 | 0.08 | — | 4.50 | — | — |
| E-9 | 2.20 | 0.12 | — | — | — | — |
| E-10 | 0.25 | 0.14 | 3.30 | — | — | 0.28 |
| E-11 | 0.32 | 1.15 | 0.50 | — | — | — |
| E-12 | — | 0.09 | — | 5.31 | 0.15 | — |
| E-13 | — | 0.08 | — | 0.28 | 2.43 | — |
| E-14 | — | 0.25 | 0.25 | — | — | 1.35 |

TABLE 8

| | Iron-based powder mixture | | | | | Pre-form | Preliminary sintering condition | | | | Annealing condition | | | |
|---|---|---|---|---|---|---|---|---|---|---|---|---|---|---|
| | Iron-based metal powder | Graphite powder | | Lubricant* | | | Atmosphere | | | | Atmosphere | | | |
| Specimen No. | Type ** | Type | Content mass % | Type | Content pbw | Density $Mg/m^3$ | Type: vol % | Nitrogen partial pressure kPa | Temperature ° C. | Time s | Type: vol % | Nitrogen partial pressure kPa | Temperature ° C. | Time s |
| 4-1 | E-1 | Natural graphite | 0.2 | Zinc stearate | 0.2 | 7.40 | Hydrogen gas: 100% | $<10^{-3}$ | 1100 | 3600 | — | — | — | — |
| 4-2 | E-2 | | 0.2 | | 0.2 | 7.40 | Hydrogen gas: 100% | $<10^{-3}$ | 1100 | 3600 | — | — | — | — |
| 4-3 | E-3 | | 0.2 | | 0.2 | 7.40 | Hydrogen gas: 100% | $<10^{-3}$ | 1100 | 3600 | — | — | — | — |
| 4-4 | E-4 | | 0.2 | | 0.2 | 7.40 | Hydrogen gas: 100% | $<10^{-3}$ | 1100 | 3600 | — | — | — | — |
| 4-5 | E-5 | | 0.2 | | 0.2 | 7.40 | Hydrogen gas: 100% | $<10^{-3}$ | 1100 | 3600 | — | — | — | — |
| 4-6 | E-6 | | 0.2 | | 0.2 | 7.40 | Hydrogen gas: 100% | $<10^{-3}$ | 1100 | 3600 | — | — | — | — |
| 4-7 | E-7 | | 0.2 | | 0.2 | 7.40 | Hydrogen gas: 100% | $<10^{-3}$ | 1100 | 3600 | — | — | — | — |
| 4-8 | E-8 | | 0.2 | | 0.2 | 7.40 | Hydrogen gas: 100% | $<10^{-3}$ | 1100 | 3600 | — | — | — | — |
| 4-9 | E-9 | | 0.2 | | 0.2 | 7.40 | Hydrogen gas: 100% | $<10^{-3}$ | 1100 | 3600 | — | — | — | — |
| 4-10 | E-10 | | 0.2 | | 0.2 | 7.40 | Hydrogen gas: 100% | $<10^{-3}$ | 1100 | 3600 | — | — | — | — |
| 4-11 | E-11 | | 0.2 | | 0.2 | 7.40 | Hydrogen gas: 100% | $<10^{-3}$ | 1100 | 3600 | — | — | — | — |
| 4-12 | E-12 | | 0.2 | | 0.2 | 7.40 | Hydrogen gas: 100% | $<10^{-3}$ | 1100 | 3600 | — | — | — | — |

TABLE 8-continued

| | Iron-based powder mixture | | | | | | Preliminary sintering condition | | | | Annealing condition | | | |
|---|---|---|---|---|---|---|---|---|---|---|---|---|---|---|
| | Iron-based metal powder | Graphite powder | | Lubricant* | | Pre-form | Atmosphere | | | | Atmosphere | | | |
| Specimen No. | Type ** | Type | Content mass % | Type | Content pbw | Density Mg/m³ | Type: vol % | Nitrogen partial pressure kPa | Temperature ° C. | Time s | Type: vol % | Nitrogen partial pressure kPa | Temperature ° C. | Time s |
| 4-13 | E-13 | | 0.2 | | 0.2 | 7.40 | Hydrogen gas: 100% | $<10^{-3}$ | 1100 | 3600 | — | — | — | — |
| 4-14 | E-14 | | 0.2 | | 0.2 | 7.40 | Hydrogen gas: 100% | $<10^{-3}$ | 1100 | 3600 | — | — | — | — |
| 4-15 | E-3 | | 0.2 | | 0.2 | 7.40 | Hydrogen gas: 75% Nitrogen gas: 25% | 25 | 1100 | 3600 | Hydrogen gas: 75% Nitrogen gas: 25% | 25 | 700 | 1800 |
| 4-16 | E-1 | | 0.2 | | 0.2 | 7.40 | Hydrogen gas: 25% Nitrogen gas: 75% | 75 | 1100 | 3600 | Hydrogen gas: 25% Nitrogen gas: 75% | 75 | 700 | 1800 |
| 4-17 | E-2 | | 0.2 | | 0.2 | 7.40 | Hydrogen gas: 10% Nitrogen gas: 90% | 90 | 1100 | 3600 | Hydrogen gas: 10% Nitrogen gas: 90% | 90 | 700 | 1800 |
| 4-18 | E-4 | | 0.2 | | 0.2 | 7.40 | Hydrogen gas: 10% Nitrogen gas: 90% | 90 | 1100 | 3600 | Hydrogen gas: 10% Nitrogen gas: 90% | 90 | 700 | 1800 |
| 4-19 | E-5 | | 0.2 | | 0.2 | 7.40 | Hydrogen gas: 10% Nitrogen gas: 90% | 90 | 1100 | 3600 | Hydrogen gas: 10% Nitrogen gas: 90% | 90 | 700 | 1800 |
| 4-20 | E-6 | | 0.2 | | 0.2 | 7.40 | Hydrogen gas: 10% Nitrogen gas: 90% | 90 | 1100 | 3600 | Hydrogen gas: 10% Nitrogen gas: 90% | 90 | 700 | 1800 |
| 4-21 | E-7 | | 0.2 | | 0.2 | 7.40 | Hydrogen gas: 10% Nitrogen gas: 90% | 90 | 1100 | 3600 | Hydrogen gas: 10% Nitrogen gas: 90% | 90 | 700 | 1800 |
| 4-22 | E-8 | | 0.2 | | 0.2 | 7.40 | Hydrogen gas: 10% Nitrogen gas: 90% | 90 | 1100 | 3600 | Hydrogen gas: 10% Nitrogen gas: 90% | 90 | 700 | 1800 |

*) Based on 100 parts by weight in total of iron-based metal powder and graphite powder
**) Refer to Table 7

TABLE 9

| | Sintered powder metal body | | | | | | | Re-compaction | Re-compacted component | | Sintered body | Sintered body after heat treatment | |
|---|---|---|---|---|---|---|---|---|---|---|---|---|---|
| | Composition (mass %) | | | | | | | Cold forging | | | | | |
| Specimen No. | O | N | Total C | Solid solution C | Free C | Density Mg/m³ | Hardness HRB | load tonf (kN) | Density Mg/m³ | Mean pore length μm | Density Mg/m³ | Density Mg/m³ | Hardness HRC |
| 4-1 | 0.08 | 0.0010 | 0.17 | 0.16 | 0.01 | 7.40 | 45 | 162 (1589) | 7.82 | <10 | 7.83 | 7.83 | 60 |
| 4-2 | 0.08 | 0.0009 | 0.17 | 0.16 | 0.01 | 7.40 | 56 | 172 (1687) | 7.81 | <10 | 7.81 | 7.81 | 61 |
| 4-3 | 0.16 | 0.0010 | 0.18 | 0.17 | 0.01 | 7.40 | 56 | 168 (1648) | 7.81 | <10 | 7.81 | 7.81 | 60 |
| 4-4 | 0.10 | 0.0011 | 0.16 | 0.15 | 0.01 | 7.40 | 57 | 170 (1667) | 7.80 | <10 | 7.81 | 7.81 | 61 |
| 4-5 | 0.22 | 0.0010 | 0.18 | 0.17 | 0.01 | 7.40 | 64 | 178 (1746) | 7.80 | <10 | 7.80 | 7.80 | 62 |
| 4-6 | 0.11 | 0.0012 | 0.17 | 0.16 | 0.01 | 7.40 | 57 | 168 (1648) | 7.82 | <10 | 7.81 | 7.81 | 61 |
| 4-7 | 0.18 | 0.0012 | 0.18 | 0.17 | 0.01 | 7.40 | 49 | 164 (1608) | 7.81 | <10 | 7.81 | 7.81 | 61 |
| 4-8 | 0.13 | 0.0011 | 0.17 | 0.16 | 0.01 | 7.40 | 62 | 177 (1736) | 7.80 | <10 | 7.80 | 7.80 | 61 |
| 4-9 | 0.10 | 0.0025 | 0.16 | 0.15 | 0.01 | 7.40 | 75 | 192 (1883) | 7.81 | <10 | 7.81 | 7.81 | 61 |
| 4-10 | 0.25 | 0.0023 | 0.18 | 0.17 | 0.01 | 7.40 | 76 | Not forgeable to a predetermined shape | | | | | |
| 4-11 | 0.15 | 0.0012 | 0.17 | 0.16 | 0.01 | 7.40 | 72 | 186 (1824) | 7.81 | <10 | 7.81 | 7.81 | 61 |
| 4-12 | 0.12 | 0.0012 | 0.17 | 0.16 | 0.01 | 7.40 | 78 | Not forgeable to a predetermined shape | | | | | |
| 4-13 | 0.10 | 0.0009 | 0.15 | 0.15 | 0.01 | 7.40 | 78 | Not forgeable to a predetermined shape | | | | | |
| 4-14 | 0.21 | 0.0011 | 0.18 | 0.17 | 0.01 | 7.40 | 73 | 187 (1834) | 7.80 | <10 | 7.81 | 7.81 | 61 |
| 4-15 | 0.16 | 0.0050 | 0.16 | 0.15 | 0.01 | 7.40 | 58 | 171 (1676) | 7.81 | <10 | 7.81 | 7.81 | 60 |
| 4-16 | 0.07 | 0.0070 | 0.17 | 0.16 | 0.01 | 7.40 | 50 | 167 (1637) | 7.81 | <10 | 7.81 | 7.81 | 60 |
| 4-17 | 0.08 | 0.0090 | 0.17 | 0.16 | 0.01 | 7.40 | 62 | 175 (1715) | 7.80 | <10 | 7.80 | 7.80 | 60 |
| 4-18 | 0.10 | 0.0095 | 0.16 | 0.16 | 0.01 | 7.40 | 62 | 181 (1774) | 7.80 | <10 | 7.80 | 7.80 | 60 |
| 4-19 | 0.21 | 0.0097 | 0.18 | 0.17 | 0.01 | 7.40 | 74 | 190 (1862) | 7.81 | <10 | 7.81 | 7.81 | 60 |
| 4-20 | 0.10 | 0.0085 | 0.17 | 0.16 | 0.01 | 7.40 | 64 | 179 (1754) | 7.80 | <10 | 7.80 | 7.80 | 60 |
| 4-21 | 0.17 | 0.0095 | 0.18 | 0.17 | 0.01 | 7.40 | 56 | 171 (1676) | 7.80 | <10 | 7.80 | 7.80 | 60 |
| 4-22 | 0.13 | 0.0090 | 0.17 | 0.16 | 0.01 | 7.40 | 69 | 187 (1833) | 7.80 | <10 | 7.80 | 7.80 | 60 |

It can be seen that any of the sintered powder metal body satisfying the constituent conditions of this invention has a high density of 7.3 Mg/m³ or more, is free from occurrence of crackings even under application of the cold forging, has high deformability, undergoes low forging load upon the cold forging, is excellent in the deformability and forgeable. Further, each of the re-compacted component satisfying the constituent conditions of this invention had a high density of 7.80 Mg/m³ or more and less number of elongate pores, and the average pore length was less than 10 μm. Further, each of the sintered bodies and the sintered bodies after the heat treatment of this invention showed no lowering of the density. The sintered body after the heat treatment showed a high hardness of HRC 60 or more.

In the sintered powder metal bodies in which the content of alloying elements are greatly larger than the range of the invention (Specimen No. 4-10, No. 4-12, No. 4-13: comparative example), the hardness of the sintered powder metal bodies were excessively high and the deformation resistance was excessively high and could not be forged to a predetermined shape. When the alloying elements were added by the contents within the range of the invention but more than the preferred range (Specimen No. 4-9, No. 4-11, No. 4-14), the forging load tended to increase somewhat.

According to this invention, (1) a sintered powder metal body of excellent deformability can be manufactured at a reduced cost, (2) re-compaction is possible at a low load, (3) the sintered powder metal body shows high deformability upon re-compaction, (4) a re-compacted component substantially of a true density can be manufactured easily to provide a significant industrial advantage. Then, when the high density component obtained by using the sintered powder metal body according to this invention is re-sintered and heat treated, (5) high strength and high density sintered body can be manufactured. Further, (6) by reducing the pores of sharp shape in the sintered body, the quality and the reliability of the sintered body can be improved, and (7) the sintered body with a high dimensional accuracy can be manufactured. According to this invention, the final density of the re-sintered body can be at least about 7.70 $Mg/m^3$, preferably, about 7.75 $Mg/m^3$ or more under a preferred condition and about 7.80 $Mg/m^3$ under an optimal condition. Further, elongate pores can also be prevented and, depending on the compaction techniques, the value for the average pore length of about 20 $\mu$m or less can generally be obtained (by the measuring method of the example).

What is claimed is:

1. An iron-based sintered powder metal body the density of which is about 7.3 $Mg/m^3$ or more, which consists of, at least about 0.10 mass % and at most about 0.50 mass % of carbon, at most about 0.3 mass % of oxygen, and at most about 0.010 mass % of nitrogen, and the remainder being iron and inevitable impurities, and which comprises at most about 0.02 mass % of free carbon.

2. An iron-based sintered powder metal body the density of which is about 7.3 $Mg/m^3$ or more, which consists of, at least about 0.10 mass % and at most about 0.50 mass % of carbon, at most about 0.3 mass % of oxygen, and at most about 0.010 mass % of nitrogen, at least one element selected from the group consisting of, at most about 1.2 mass % of manganese, at most about 2.3 mass % of molybdenum, at most about 3.0 mass % of chromium, at most about 5.0 mass % of nickel, at most about 2.0 mass % of copper, and at most about 1.4 mass % of vanadium, and the remainder being iron and inevitable impurities, and which comprises at most about 0.02 mass % of free carbon.

* * * * *